US010124985B2

(12) United States Patent
Jiang et al.

(10) Patent No.: US 10,124,985 B2
(45) Date of Patent: Nov. 13, 2018

(54) CABLE RETRACTION SYSTEMS AND ASSOCIATED METHODS THEREOF

(71) Applicant: Panasonic Avionics Corporation, Lake Forest, CA (US)

(72) Inventors: Feng Jiang, Irvine, CA (US); Shrenik Shah, Lake Forest, CA (US)

(73) Assignee: Panasonic Avionics Corporation, Lake Forest, CA (US)

( * ) Notice: Subject to any disclaimer, the term of this patent is extended or adjusted under 35 U.S.C. 154(b) by 130 days.

(21) Appl. No.: 15/457,614

(22) Filed: Mar. 13, 2017

(65) Prior Publication Data

US 2018/0257905 A1 Sep. 13, 2018

(51) Int. Cl.
*B65H 75/48* (2006.01)
*B65H 75/44* (2006.01)

(52) U.S. Cl.
CPC ..... *B65H 75/4434* (2013.01); *B65H 75/48* (2013.01); *B65H 2701/3919* (2013.01)

(58) Field of Classification Search
CPC ..... B65H 75/48; B65H 75/4434; B65H 2701/3919
See application file for complete search history.

(56) References Cited

U.S. PATENT DOCUMENTS

| | | | | |
|---|---|---|---|---|
| 5,769,349 | A * | 6/1998 | Grosselin | B64D 1/04 242/385.1 |
| 6,019,304 | A | 2/2000 | Skowronski et al. | |
| 6,293,485 | B1 | 9/2001 | Hollowed | |
| 6,372,988 | B1 | 4/2002 | Burke et al. | |
| 7,108,216 | B2 | 9/2006 | Burke et al. | |
| 7,681,823 | B2 | 3/2010 | Chang | |
| 2008/0054116 | A1* | 3/2008 | Han | A45F 5/004 242/385.2 |
| 2013/0125832 | A1* | 5/2013 | Tang | A01K 27/004 119/794 |
| 2013/0284114 | A1* | 10/2013 | Bizzell | A01K 27/004 119/796 |

* cited by examiner

*Primary Examiner* — Sang K Kim
(74) *Attorney, Agent, or Firm* — Klein, O'Neill & Singh, LLP

(57) ABSTRACT

A cable retraction system for use with a cable. The system includes a slider configured to slide in a vertical plane within a channel; and a spring having a first segment connected to the slider and a second segment with a bent tip that traverses a groove and ramp segment with a movement of the slider. In an initial state, the cable does not retract and the bent tip is located at a lowest position of the groove and ramp segment in the vertical plane; and after the cable is pulled, the slider slides upwards in the channel and the bent tip of the second spring traverses a ramp of the groove and ramp segment.

20 Claims, 30 Drawing Sheets

CABLE RETRACTION SYSTEMS AND ASSOCIATED METHODS THEREOF

TECHNICAL FIELD

The present disclosure relates to cable retraction systems and associated methods.

BACKGROUND

Cord and reel mechanisms are typically used to extend and limit the use of a device, for example, a handset that is attached to a seat of a transportation vehicle, for example, an aircraft. Conventional cord and reel mechanisms typically use a ratchet/pinion mechanism that stops cable movement for every rotation at a fixed length. This is undesirable because cable wear is concentrated on certain pre-defined spots where the mechanism always stops and the cable makes contact with a cord reel housing, a cradle port from where the cable exits or any other mechanical part that may be in contact. Thus, conventional systems can cause premature damage to cables due to shorting or wear/tear, which can be dangerous on an aircraft. Furthermore, the ratchet/pinion type systems make a loud clicking sound that may be undesirable, for example, on aircraft where passengers/crew sit in close proximity to each other.

Continuous efforts are being made to develop better cable retraction technology that provides quieter systems, reduces cable wear/tear and also provides better resolution for cable movement, rather than fixed lengths of conventional systems.

BRIEF DESCRIPTION OF THE DRAWINGS

The various features of the present disclosure will now be described with reference to the drawings of the various aspects disclosed herein. In the drawings, the same components may have the same reference numerals. The illustrated aspects are intended to illustrate, but not to limit the present disclosure. The drawings include the following Figures.

DETAILED DESCRIPTION

Figure 1A:
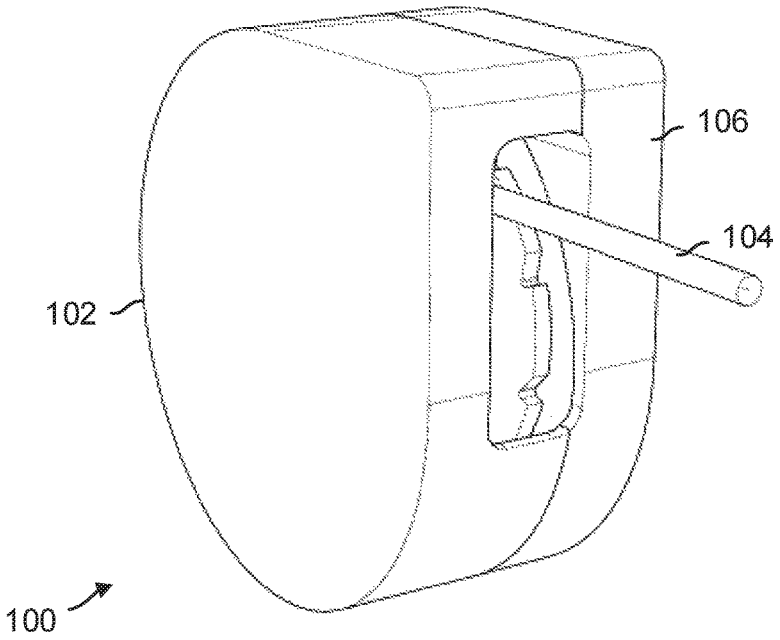
FIG. 1A shows a three dimensional (3D) view of a cable retraction system, according to one aspect of the present disclosure.

The detailed description set forth below in connection with the appended drawings is intended as a description of an innovative cable retraction system in accordance with the various aspects of the present disclosure and is not intended to represent the only forms in which the present disclosure may be constructed or utilized. The description sets forth the features and the steps for constructing and using the innovative cable retraction system. It is to be understood, however, that the same or equivalent functions and structures may be accomplished by different aspects that are also intended to be encompassed within the spirit and scope of the present disclosure defined by the appended claims.

In one aspect, innovative technology for cable retraction systems is disclosed herein. One innovative cable retraction system of the present disclosure includes a center hub (116, FIG. 1C) with a plurality of notches (504A-504N, FIG. 5A). A cable (104, FIG. 1A) is wound on a first cylindrical portion (118, FIG. 5A) of the center hub that also uses a recoil spring (120, FIG. 1C) that pulls the cable into a housing (102, FIG. 1C). The system includes a cam-shaped friction arm (114, FIG. 1C) (also referred to herein as a "cam") that is placed on a second cyclindrical portion (119, FIG. 1D) of the center hub. The contact between the cam and the center hub provides controlled friction such that when the hub spins, the cam spins with it until a stopping mechnism is triggered, as described below in detail.

In one aspect, the cable retraction system housing includes a protrusion (126, FIG. 1C) that operates as a "stopper" to limit the rotation of the cam to a specific angle. When the cam reaches the rotational limit, it starts to slip relative to the hub, as described below in detail. The cable retraction system further includes a slider (110, FIG. 3A) that slides upwards or downwards within a chanel (204, FIG. 2A) of an inside wall of the housing. The slider is pushed upwards relative to the cam, when the cam makes contact with the slider.

In one apsect, the innovative mechnism uses a first torsion spring (108, FIG. 3A) that constantly pushes the slider to return to its lowest possible position. A second torsion spring (112, FIG. 3A) is mounted within a slot on a side of the slider. The second torsion spring has a short end (a first segment) and a long end (a second segment). The short end is placed within the slot of the slider. The long end of the second torsion spring has a bent tip, for example, a 90 degree bent tip. Due to the geoemtry and mounting of the second torsion spring to the slider, the bent tip can swing in a plane, relative to a rotational plane of the cam. As described below in detail, due to the orientation of the second torsion spring, it always attempts to move to the "right most" possible location. The bent tip may swing out of the aformentioned plane due to an external force.

In one aspect, the cable retraction system uses a groove and ramp segment (203, FIG. 2B) that is provided on the inside wall of the housing. As an example, the groove may be heart shaped. The bent tip of the second torsion spring moves within the groove and ramp segment.

When a user pulls on the cable, the center hub rotates in the clockwise direction. Friction causes the cam to rotate with the center hub. The rotating cam pushes the slider upwards in the housing chanel. The fixed end of the first torsion spring moves upwards with the slider. The position of the bent tip of the second torsion spring is located at the lowest position in the groove structure. The bent tip is pushed to the left by a tilted surface (205, FIG. 2B) until the bent tip reaches the top of the groove. The stopper on the housing stops the rotation of the cam that slips on the center hub while cable is being pulled out.

When the user releases the cable, the recoil spring inside the center hub rotates the hub in the counter-clockwise direction. The cam also rotates in the counter-clockwise direction. The first torsion spring on top of the slider presses the slider down. The bent tip of the second torsion spring is placed in the middle of the groove (212, FIG. 2B) that is shown as a valley in the accompanied drawings. This stops the slider's downward slide. A protrusion (306, FIG. 3A) on a front side of the slider doesn't engage with any of the plurality of slots (or notches) located on the perimeter of the center hub. It is noteworthy that the slider protrusion and the notches may be in the same plane.

In a disengaged state, the cable is retracted and the slider is unable to slide downwards. The recoil spring inside the center hub rotates the hub counter-clockwise freely until the entire cable is retracted. The cam is also stopped by the stopper and slips on the center hub.

When a user pulls the cable, the center hub again rotates clockwise and the cam moves with the hub. The slider slides upwards until the bent tip of the second torsion spring reaches a top position of the groove and the cam is stopped by the housing stopper. The user can further pull out the cable while the cam is slipping on the center hub.

When the user releases the cable, the recoil spring rotates the hub counter-clockwise and the cam moves with the center hub. The slider slides down due to the first torsion spring. The bent tip starts to slide on the ramp (or slot) inside the groove. The ramp pushes the bent tip out of plane untill the tip travels down and springs back in plane. This is the lowest position of the slider and the protrustion on the front side of the slider is caught by a next available notch on the center hub. This stops the center hub from rotating counter-clockwise, which stops the cable retraction. This state is designated as an engaged state, where cable does not retract. The mechanism alternates between disengaged and engaged states, as described below in detail with respect to the accompanied drawings.

System 100: FIG. 1A shows an example of a cable retraction system (or assembly) 100 (may also be referred to as "system 100" or "assembly 100") having a housing 102, a cover 106 and a cable 104 that can be pulled by a user (also referred to herein as a passenger or crew member) and retracted by system 100, as described below in detail. System 100 may be coupled to a seat (not shown) at one end and the cable 104 may be coupled to a handset 105 (FIG. 1B)

at one end. The seat may be a passenger/crew member seat on an aircraft or any other transportation vehicle type, including trains, busses, cars, recreation vehicles, ships and others.

Figure 1B:
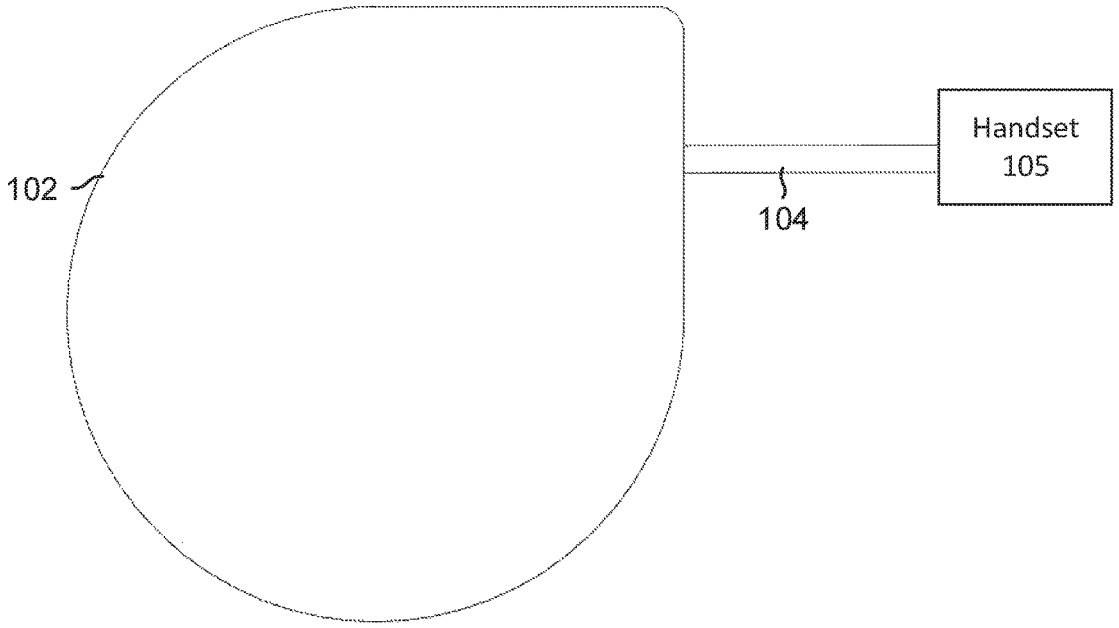
FIG. 1B shows a front two-dimensional (2D) view of the system of FIG. 1A with a handset, according to one aspect of the present disclosure.

FIG. 1B shows a two-dimensional front view of system 100 with the housing 102. Cable 104 may be coupled to a handset 105 that may be used to access seat functions and content on transportation vehicles that use various computing devices for providing various functions, including entertainment, system control, content storage, and other functions.

Transportation vehicles may have individualized functional equipment dedicated to a particular passenger (or crew member) seat, which can be utilized by the passenger using handset 105, such as adjustable seats, adjustable environmental controls, adjustable lighting, telephony systems, video and/or audio entertainment systems, crew communication systems, and the like. As an example, many commercial airplanes today have individualized video and audio entertainment systems, often referred to as "inflight entertainment" or "IFE" systems. Such systems may also be referred to as "inflight entertainment and communication" systems as well, and typically abbreviated as "IFEC" systems. An example of an aircraft passenger IFE systems, include Series 2000, 3000, eFX, eX2, eXW, and/or any other inflight entertainment system developed and provided by Panasonic Avionics Corporation (without derogation of any trademark rights of Panasonic Avionics Corporation) of Lake Forest, Calif., the assignee of this application. It is noteworthy that the adaptive features of the present system is not limited to any specific IFE system or any other functionality and can be used in a broad range of applications.

Figure 1C:
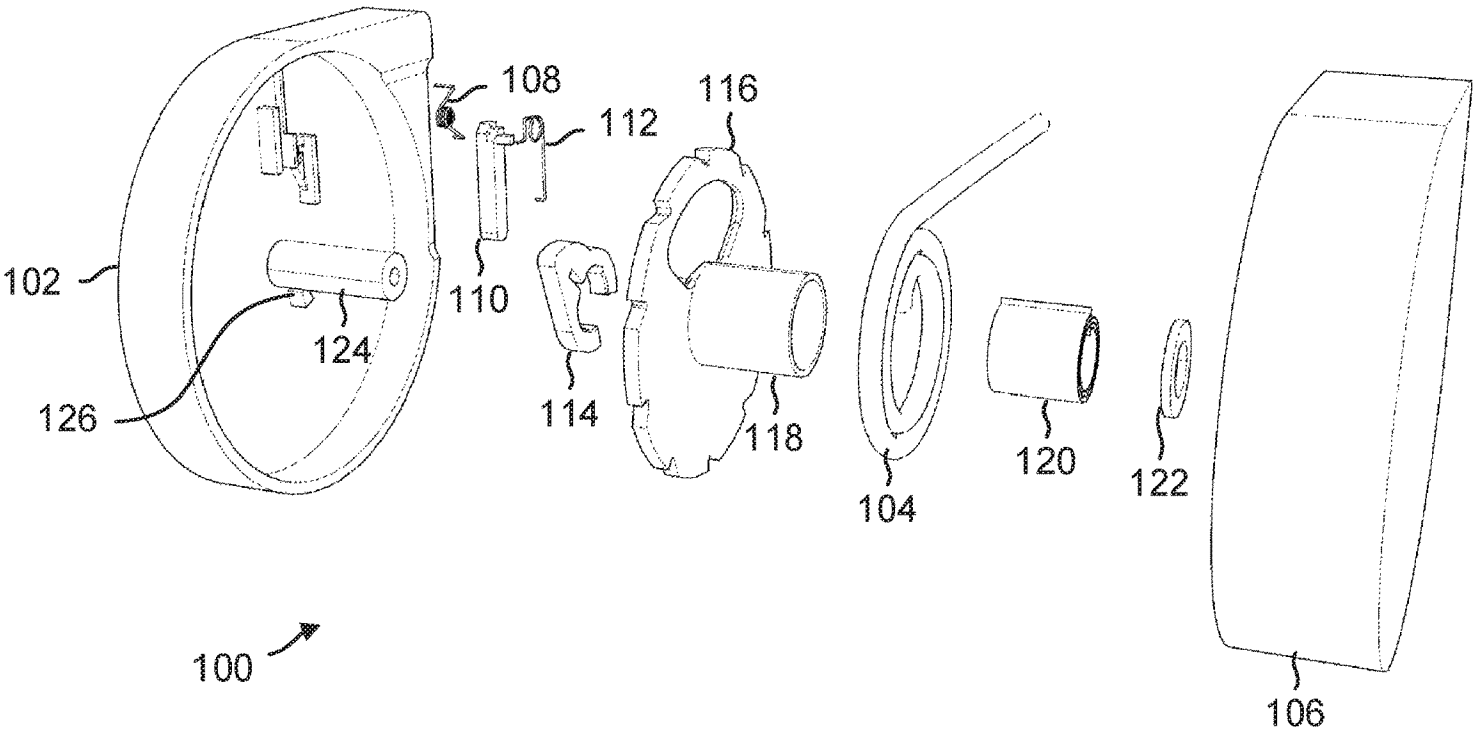
FIGS. 1C and 1D show exploded views of the cable retraction system 100 of FIG. 1A, according to one aspect of the present disclosure

FIG. 1C shows an exploded three dimensional (3D) view of system 100 having a plurality of components, including the housing 102 with a cylindrical structure/protrusion 124 and a stopper 126 that limits rotational distance of a cam 114 as described below in detail.

In one aspect, system 100 further includes a slider 110, a first torsion spring 108 and a second torsion spring 112. The functionality of slider 110 and springs 108/112 is described below in detail.

Figure 1D:
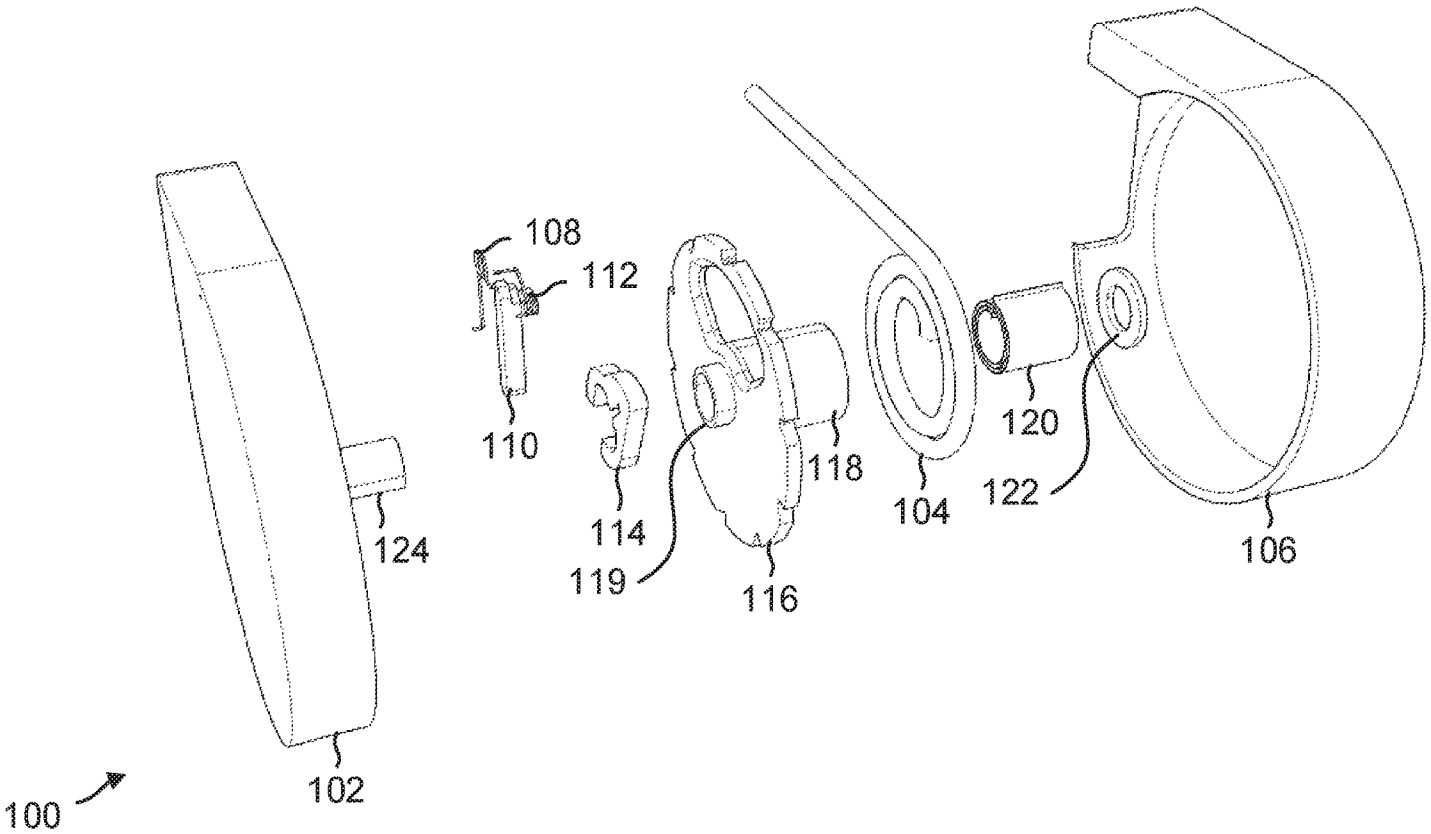

System 100 further includes a center hub 116 with a first cylindrical portion 118 on one side and a second cylindrical portion 119 on an opposite side (shown in FIG. 1D). The cable 104 is oriented/wrapped around a circumference of the first cylindrical portion 118, while cam 114 engages around the circumference of second cylindrical portion 119. A recoil spring 120 is placed in an opening of the first cylindrical portion 118 and prevents retraction of cable 104, as described below in detail. A cover 122 is secured on the opening of the first cylindrical portion 118 to protect the recoil spring 120.

FIG. 1D shows another exploded view of system 100 with the same components of FIG. 1C from a different angle. FIG. 1D also shows the second cylindrical portion 119 of the center hub 116. The cam 114 operating as a friction arm rotates along the circumference of the second cylindrical portion 119 that also mates with the cylindrical protrusion 124 of housing 102. Details regarding the various components of system 100 are provided below.

Figure 2A:
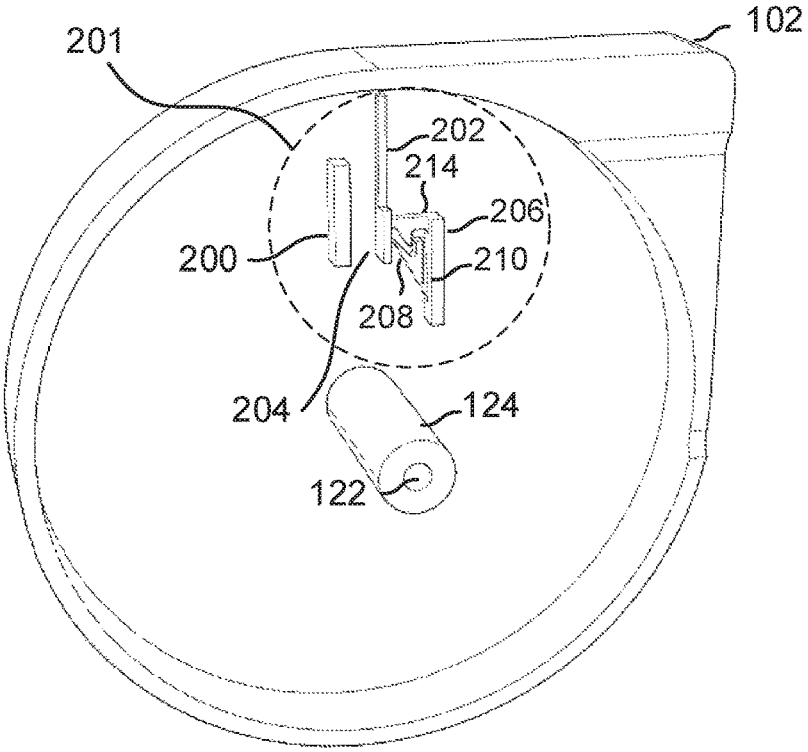
FIG. 2A shows a 3D view of a housing used by the cable retraction system 100, according to one aspect of the present disclosure.
Figure 2E:
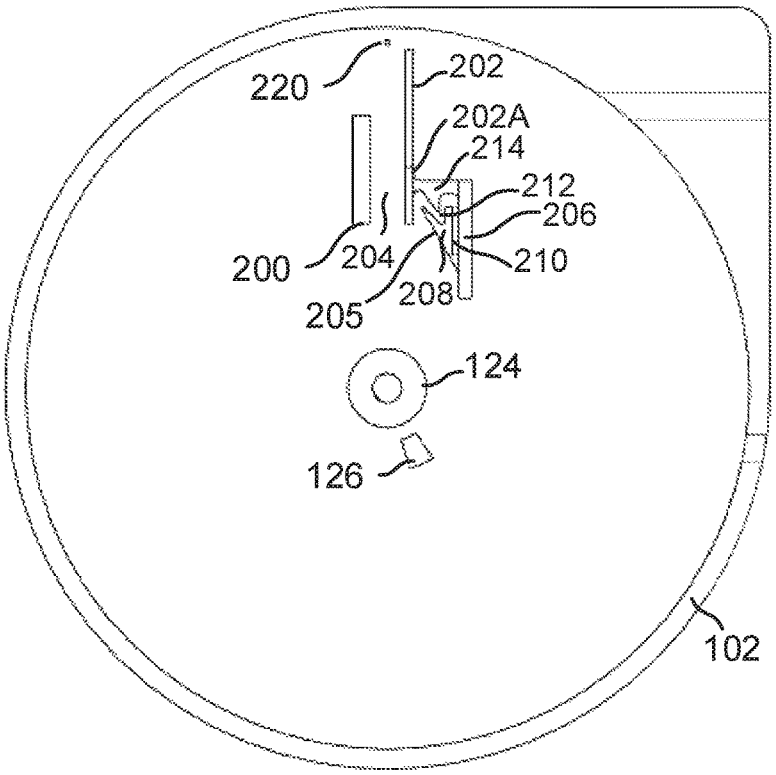
FIG. 2E shows a 2D front view of the housing of FIG. 2A, according to one aspect of the present disclosure.
Figure 2B:
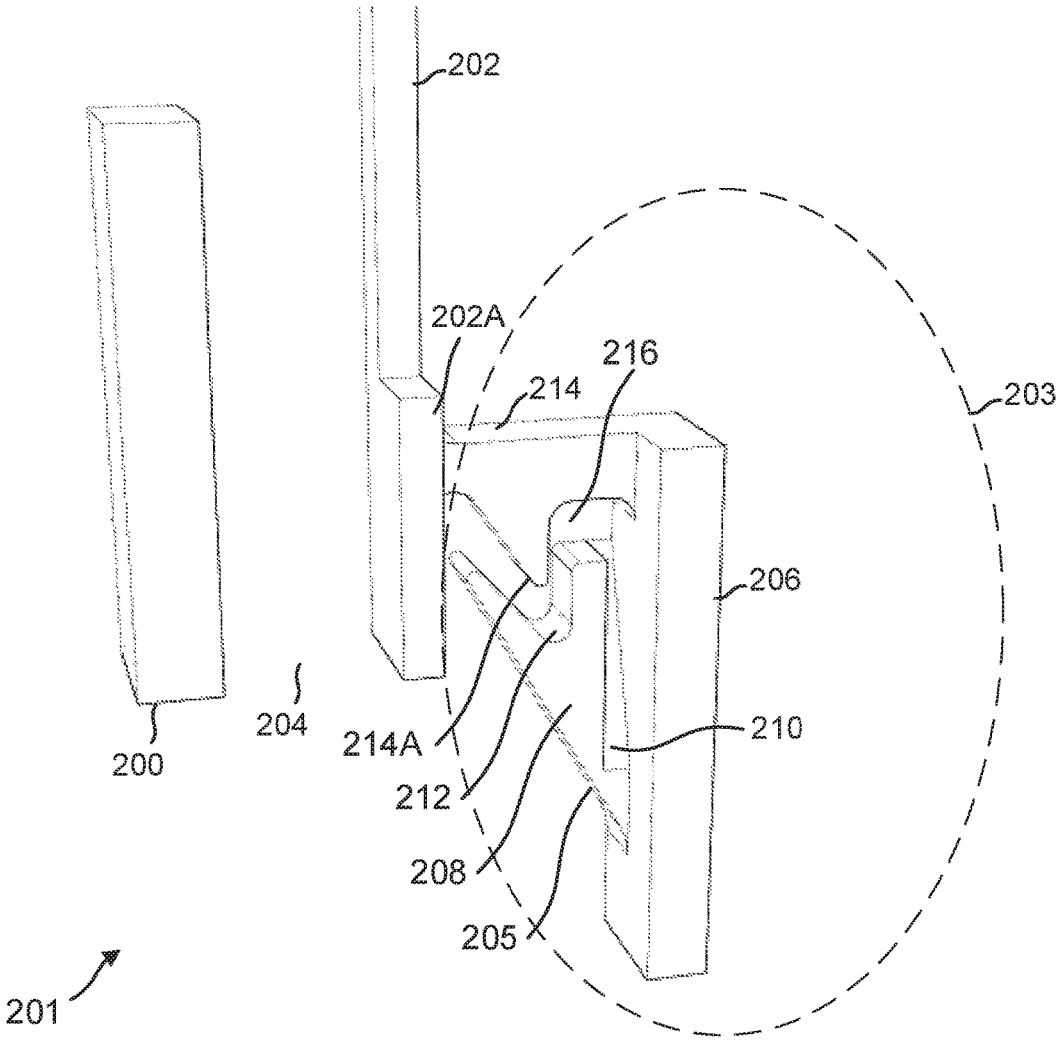
FIGS. 2B, 2C and 2D show details of various features of the housing of FIG. 2A, according to one aspect of the present disclosure.

Housing 102: FIGS. 2A-2E show a plurality of views of housing 102 with various innovative features, according to one aspect of the present disclosure. For example, FIG. 2A shows a front 3D view of housing 102 with the cylindrical protrusion 124 having an opening 124A that is described below in more detail. Housing 102 includes various other details and some of them are shown within a dotted circle 201. The details within the dotted circle 201 include a channel 204 that is created by rectangular structures (or protrusions) 200 and 202, shown in detail in FIG. 2B. Protrusion 202 is an L shaped structure where a portion 202A of the L-shaped structure is adjacent to a groove and ramp segment (shown within the dotted circle 203 of FIG. 2B). The slider 110 slides in a vertical plane within the channel 204 in an upward or downward direction, as described below in detail.

In one aspect, the groove and ramp segment includes a first horizontal rectangular portion 214 and a vertical rectangular portion 206. A groove/opening 216 is created by structure 208 that is partially triangular and the geometry of the lower portion 214A of the first horizontal rectangular portion 214. The lowest portion of the groove/opening 216 is shown as a valley 212 as part of structure 208. A hypotenuse surface (or tilted surface) of the triangular portion of structure 208 is shown as 205. A ramp 210 is created between structure 208 and the vertical rectangular portion 206. The ramp 210 is used by the second torsion spring 112 to travel downwards, as described below in more detail.

Figure 2C:
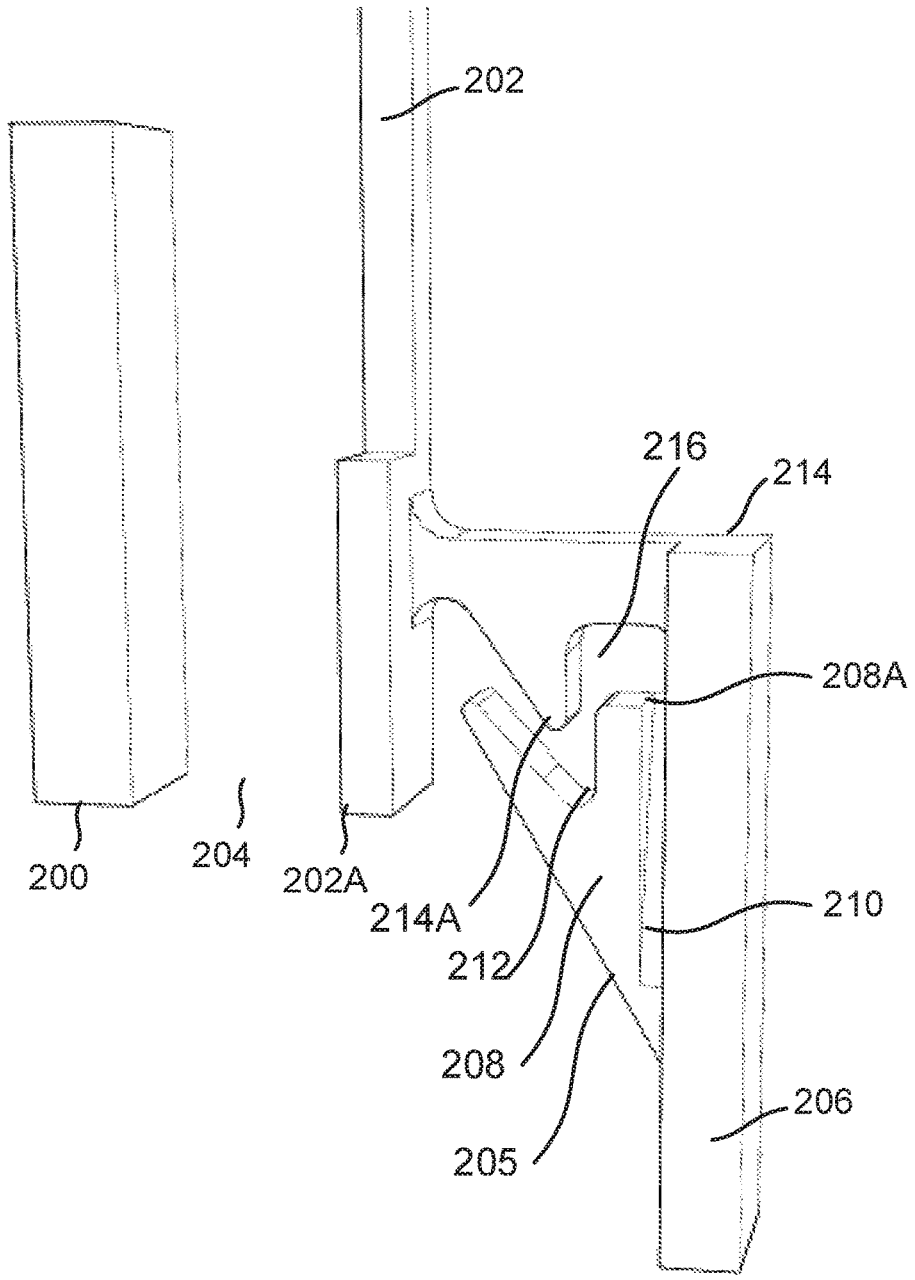
Figure 2D:
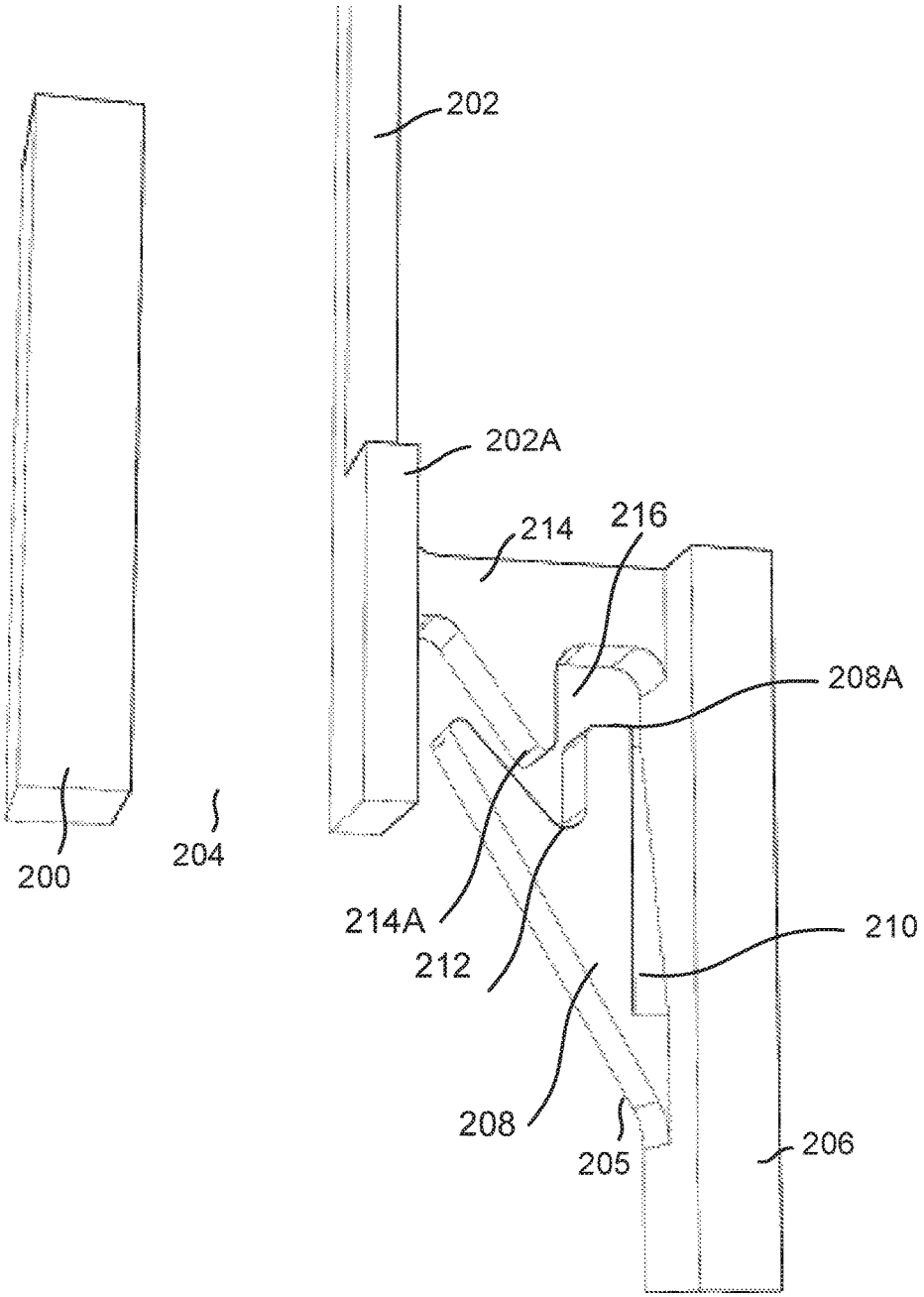

FIGS. 2C-2D shows different views for the details within the dotted circles 201 and 203, respectively, according to one aspect of the present disclosure. FIG. 2E shows a front 2D view of the housing 102 with the stopper 126. The housing 102 also includes a hole/opening 220 that receives one end of the first torsion spring 108, described below in detail. The use of channel 204, the hypotenuse surface 205, groove 216, ramp 210 and the valley 212 is described below in detail with respect to other components of system 100.

Figure 3A:
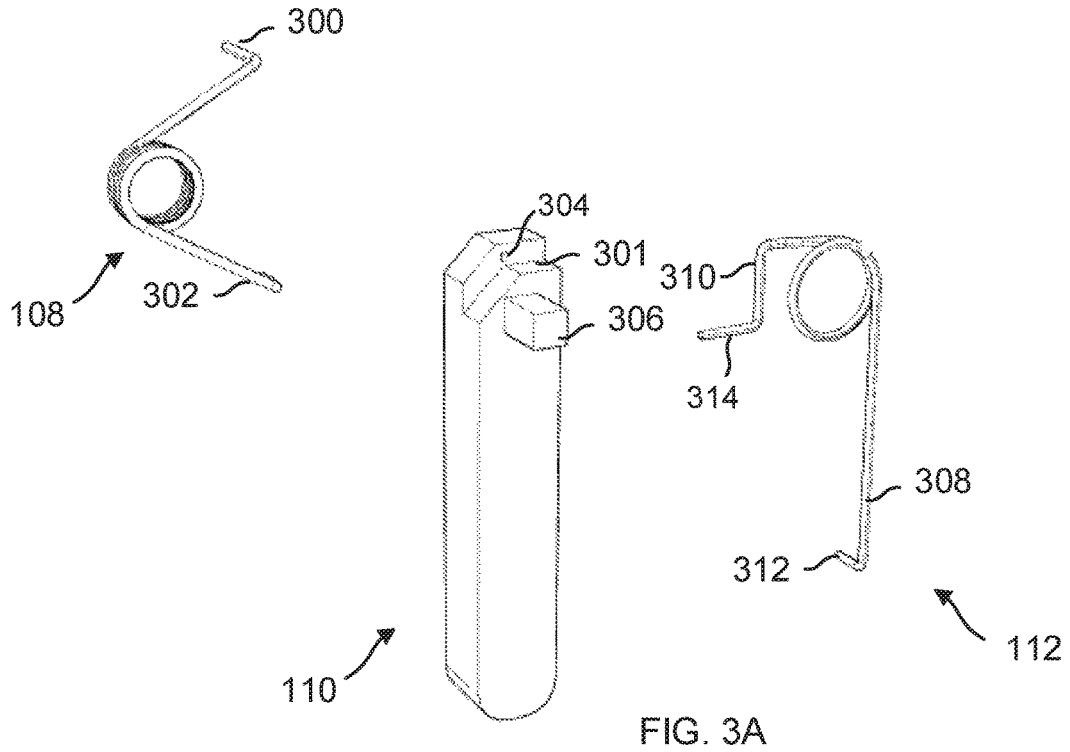
FIGS. 3A and 3B show 3D views of a first torsion spring, a slider mechanism and a second torsion spring, used in the cable retraction system of FIG. 1A, according to one aspect of the present disclosure.

First Spring/Second Spring and Slider Details: FIGS. 3A-3F show various views with features of the first torsion spring 108, the slider 110 and the second torsion spring 112, according to one aspect of the present disclosure. For example, FIG. 3A shows the slider 110 with an opening/hole 304, a protrusion 306 and a flat surface 301 aligned with the opening 304. The protrusion 306 engages with a notch (504A-504N, FIG. 5A) of the center hub 116, as described below in detail.

Figure 3B:
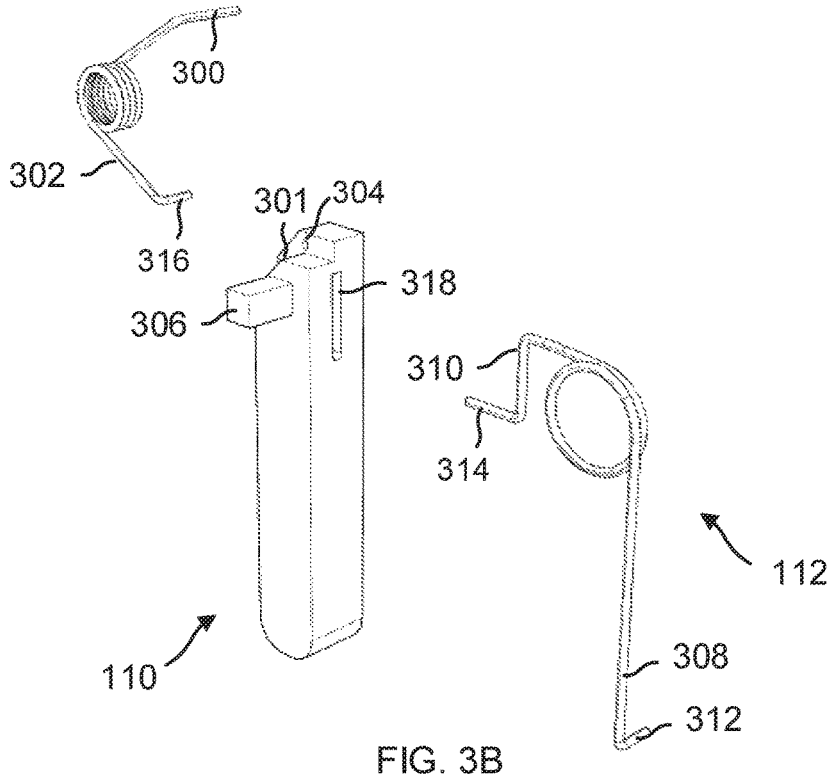

The first torsion spring 108 includes a top segment 300 that is secured within opening 220 of the housing 102 (shown in FIG. 2E). A second segment 302 of the first torsion spring 108 includes a bent portion 316 (FIG. 3B). The bent portion 316 is secured in opening 304 of the slider to vertically apply pressure on the slider 110, as described below in detail.

As shown in FIGS. 3A/3B, the second torsion spring 112 includes a first segment 310 with a bent portion 314. The bent portion 314 is placed in a slot 318 of the slider 110 (shown in FIG. 3B). The second segment 308 of the second torsion spring 112 also has a bent portion 312 that travels along the hypotenuse surface 205, onto the valley 212 and then through ramp 210, as described below in detail.

Figure 3C:
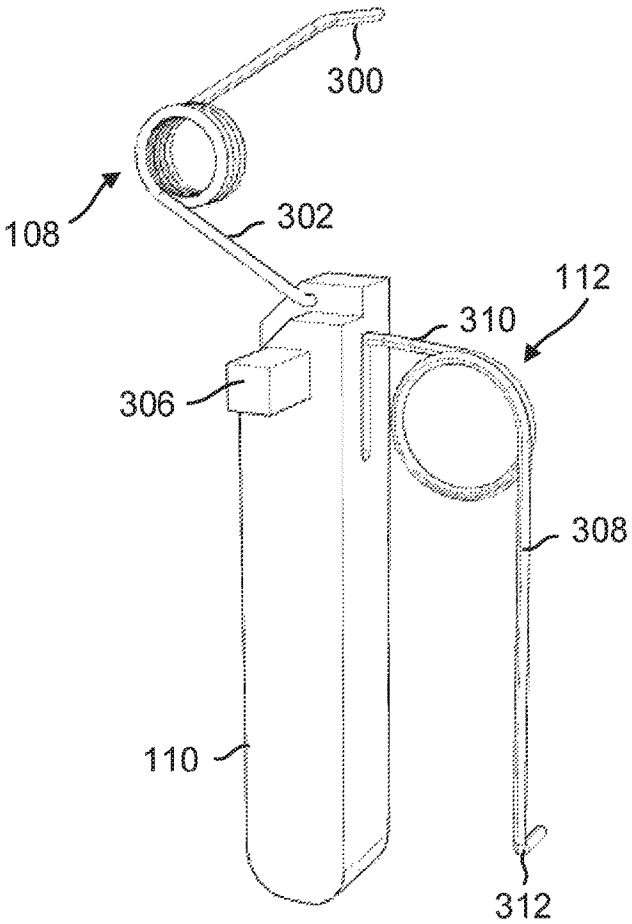
FIG. 3C shows a 3D view of an assembly of the first torsion spring, the slider mechanism and the second torsion spring of FIG. 3A, according to one aspect of the present disclosure.
Figure 3D:
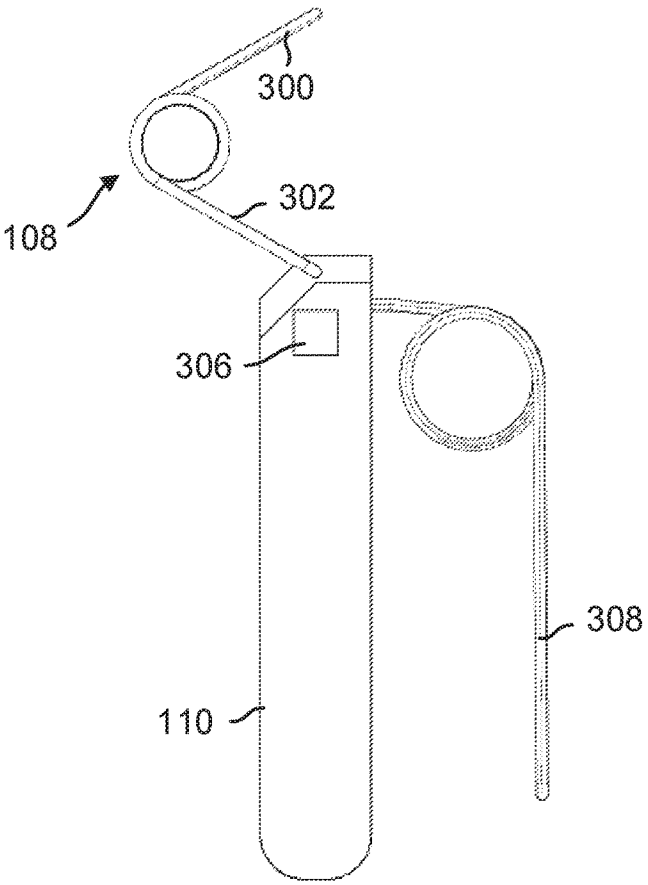
FIG. 3D shows a 2D front view of the assembly of FIG. 3C, according to one aspect of the present disclosure.
Figure 3E:
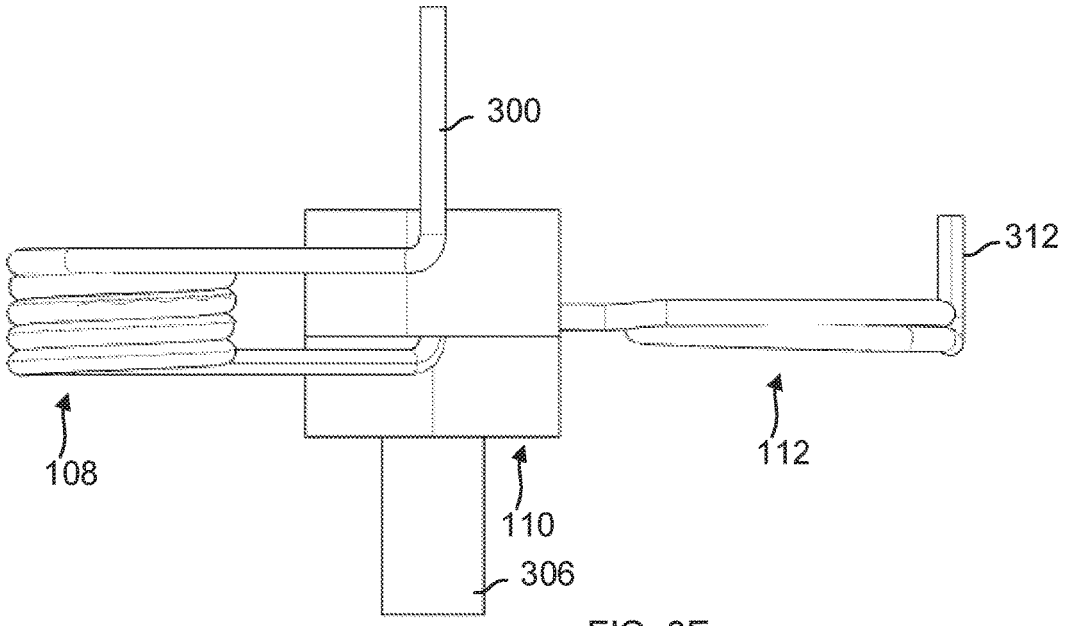
FIG. 3E shows a top-2D view of the assembly of FIG. 3C, according to one aspect of the present disclosure.
Figure 3F:
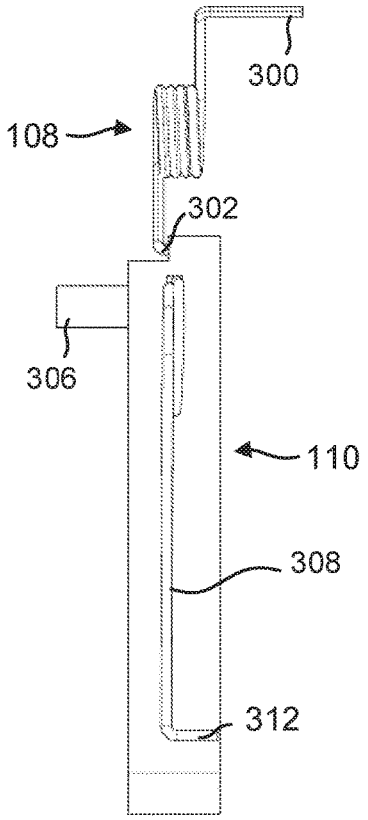
FIG. 3F shows a 2D side view of the assembly of FIG. 3C, according to one aspect of the present disclosure.

FIG. 3C shows an assembled 3D view with the first torsion spring 108, the second torsion spring 112 and the slider 110. FIG. 3D shows a 2D assembled view of the first torsion spring 108, the second torsion spring 112 and slider 110. FIG. 3E shows a 2D top view of the assembly of FIG. 3C and FIG. 3F shows a right hand side view of the assembly of FIG. 3C.

Figure 4A:
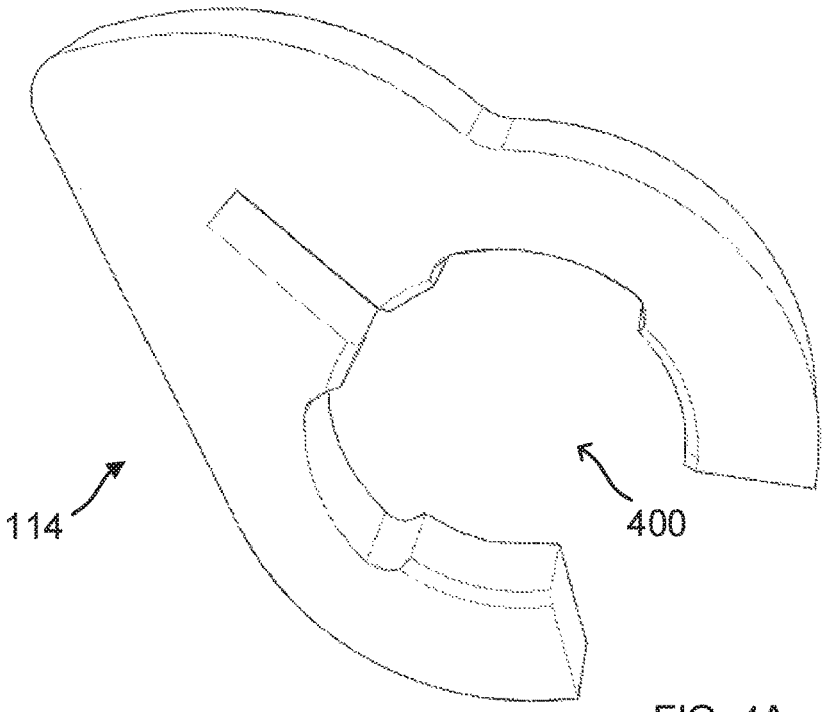
FIG. 4A shows a 3D view of a cam used in the system of FIG. 1A, according to one aspect of the present disclosure.
Figure 4B:
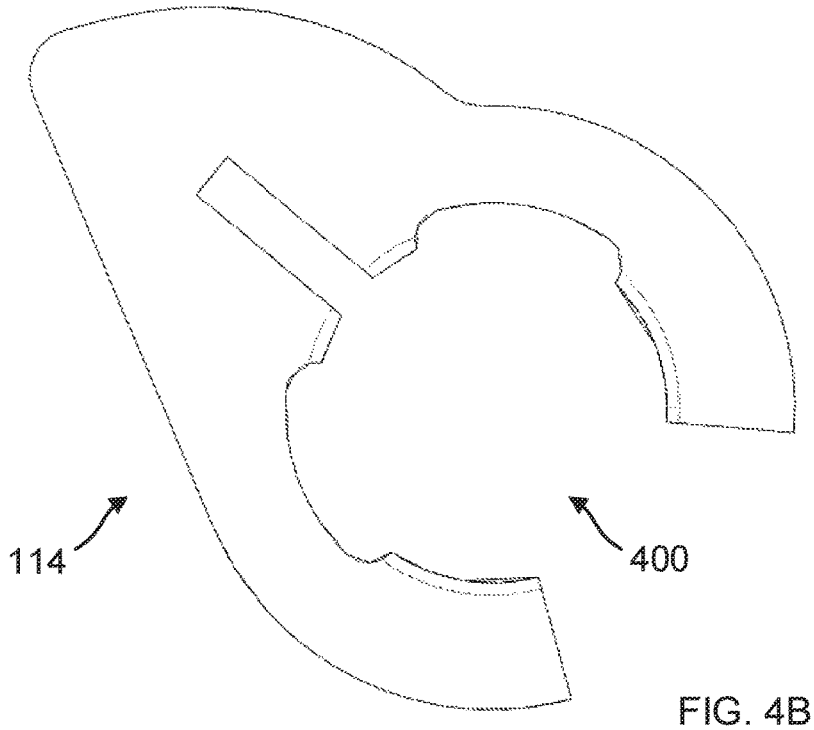
FIG. 4B shows a 2D view of a cam used in the system of FIG. 1A, according to one aspect of the present disclosure.

Cam 114: FIG. 4A shows a 3D view of the cam 114 with an opening 400 that rotates along the circumference of the cylindrical portion 119 of the center hub 116. The rotational distance is limited by stopper 126, as described below in detail. FIG. 4B shows a top view of cam 114, according to one aspect of the present disclosure. Details of cam 114 functionality are provided below.

Figure 5A:
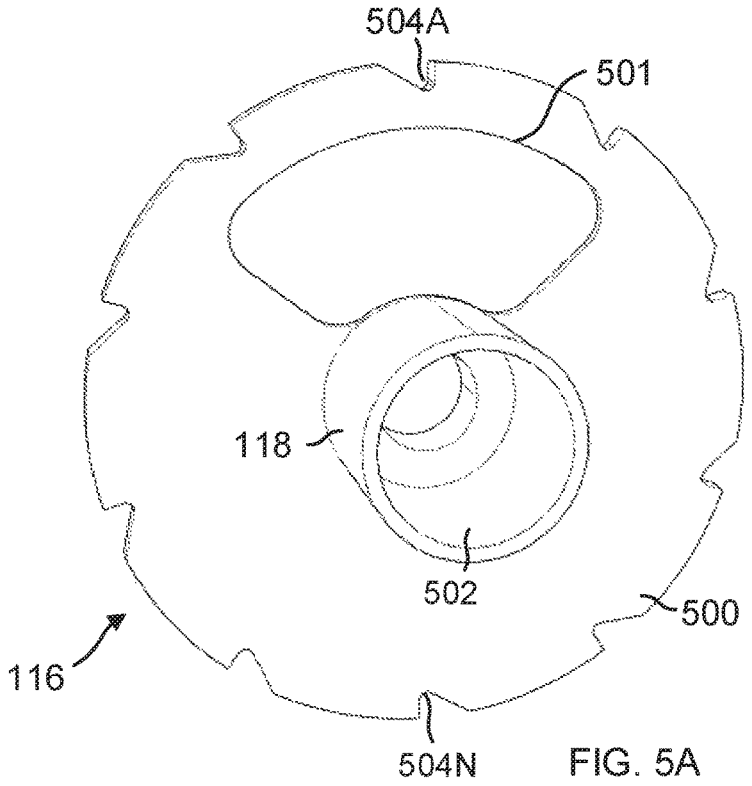
FIG. 5A shows a 3D view of a center hub used in the system of FIG. 1A, according to one aspect of the present disclosure.

Center Hub 116: FIGS. 5A-5D show various views of the center hub 116 illustrating the various innovative features, according to one aspect of the present disclosure. FIG. 5A shows a first 3D view of the center hub 116 with a main body 500 having a circular shape. A cutout 501 has been shown only for convenience to illustrate various features behind the center hub 116.

FIG. 5A also shows a plurality of notches 504A-504N that are arranged along the perimeter of the center hub 116 that can engage with protrusion 306 of the slider 110. FIG. 5A also shows the first cylindrical portion 118 with an opening 502 that engages with protrusion 124 of the housing 102 and receives the recoil spring 120, described below in detail.

Figure 5B:
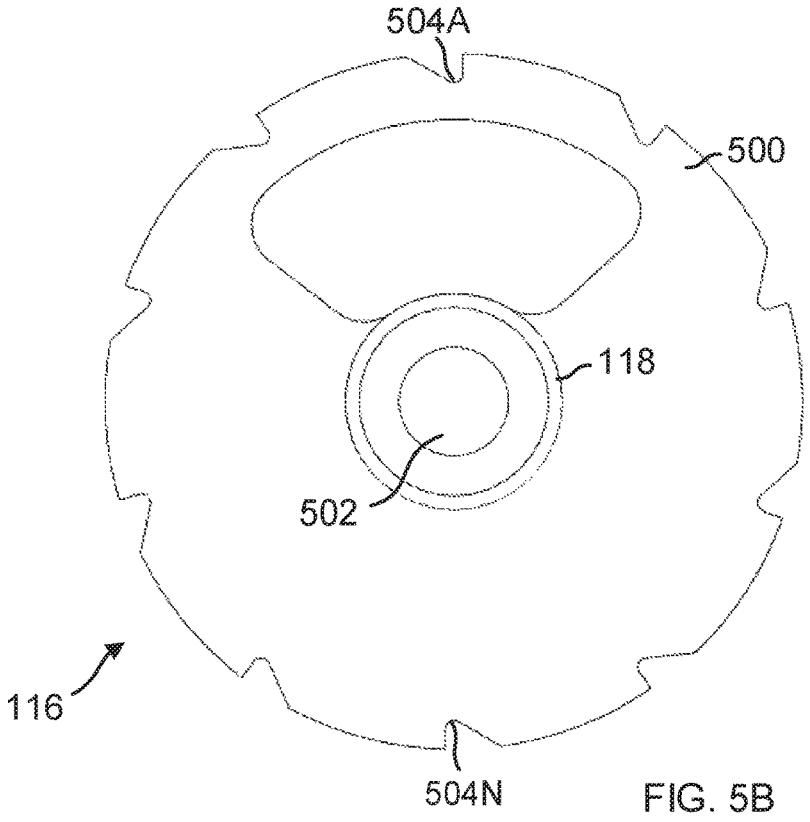
FIG. 5B shows a 2D view of the center hub of FIG. 5A, according to one aspect of the present disclosure.
Figure 5C:
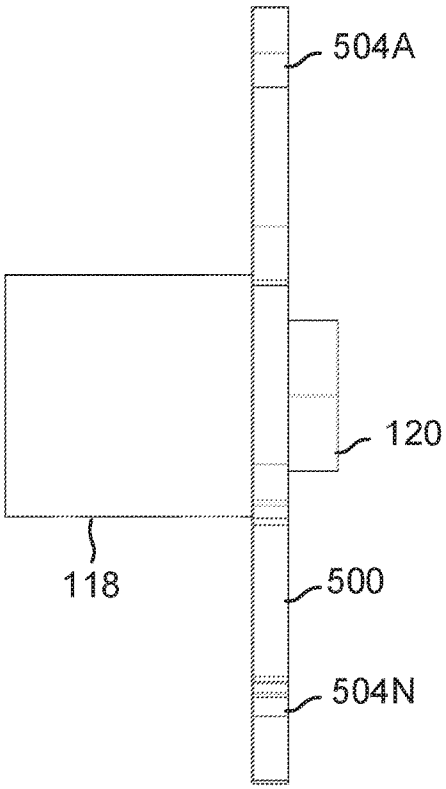
FIG. 5C shows a 2D side view of the center hub of FIG. 5A, according to one aspect of the present disclosure.
Figure 5D:
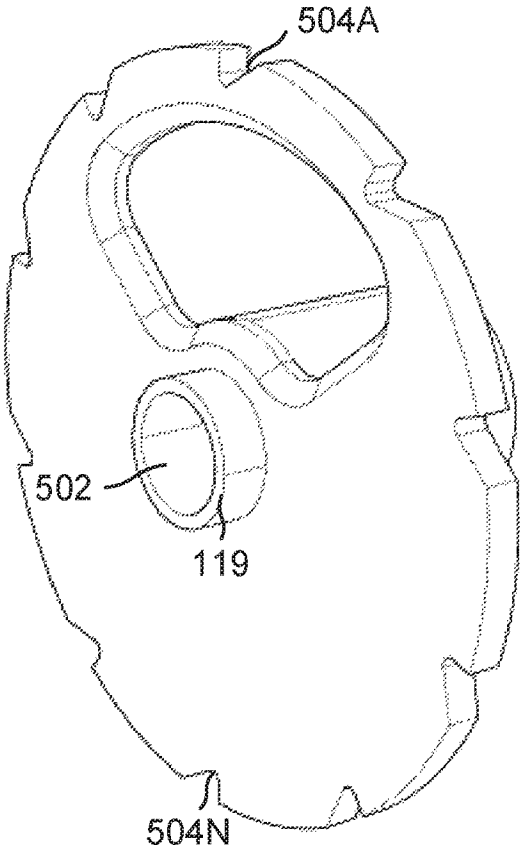
FIG. 5D shows yet another 3D view of the center hub of FIG. 5A, according to one aspect of the present disclosure.

FIG. 5B shows a front 2D view of the center hub 116, while FIG. 5C shows a 2D right hand side view of the center hub 116. FIG. 5D shows a 3D rear view of the center hub 116 with the second cylindrical portion 119 that engages with cam 114 and protrusion 124 of housing 102.

Figure 6A:
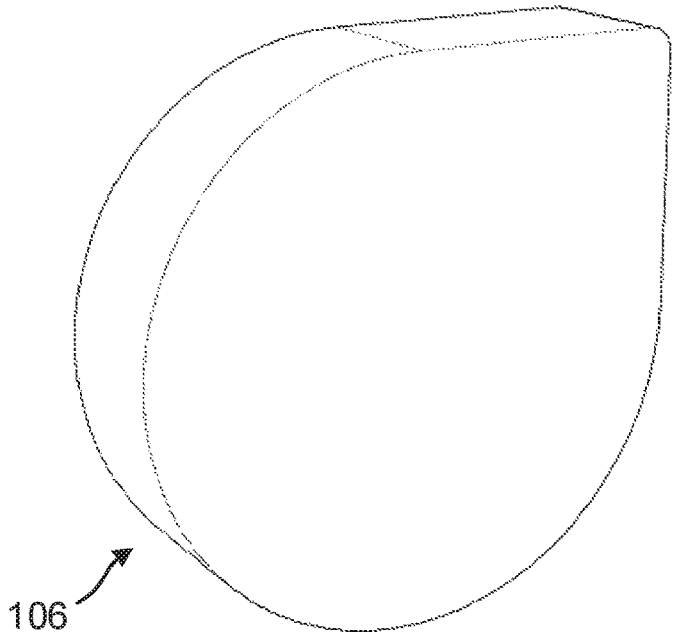
FIG. 6A shows a 3D view of a cover used in the system of FIG. 1A, according to one aspect of the present disclosure.
Figure 6B:
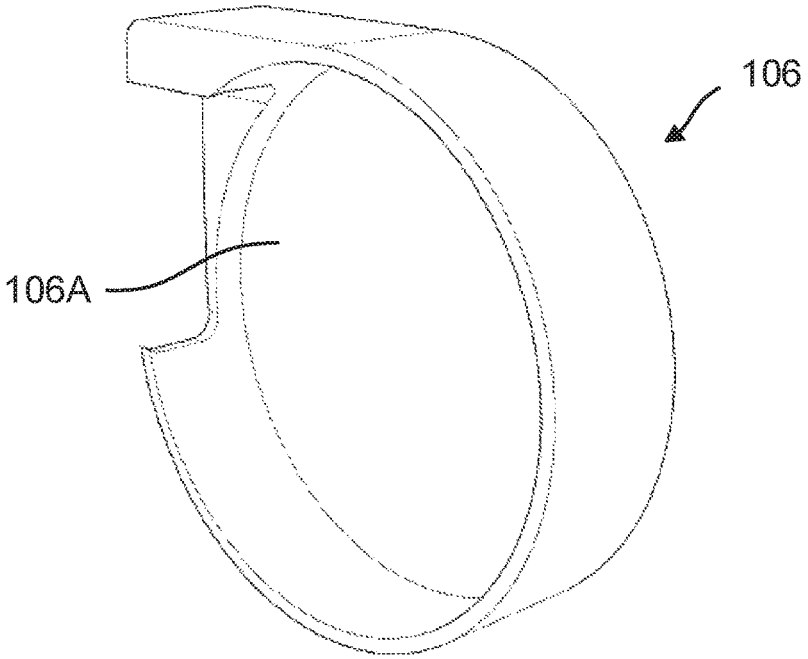
FIG. 6B shows a 2D view of the cover of FIG. 6A, according to one aspect of the present disclosure.

Cover 106: FIG. 6A shows a front, 3D view of cover 106, while FIG. 6B shows the rear 3D view of cover 106 with an interior surface 106A. As shown in FIG. 1C described above, cover 106 engages with the housing 102 to protect the various components of system 100. The engagement mechanism between cover 106 and housing 102 may be based on using fasteners, grooves, adhesives or any other type. The adaptive aspects described herein are not limited to any specific mechanism used for securing cover 106 on housing 102.

Figure 7A:
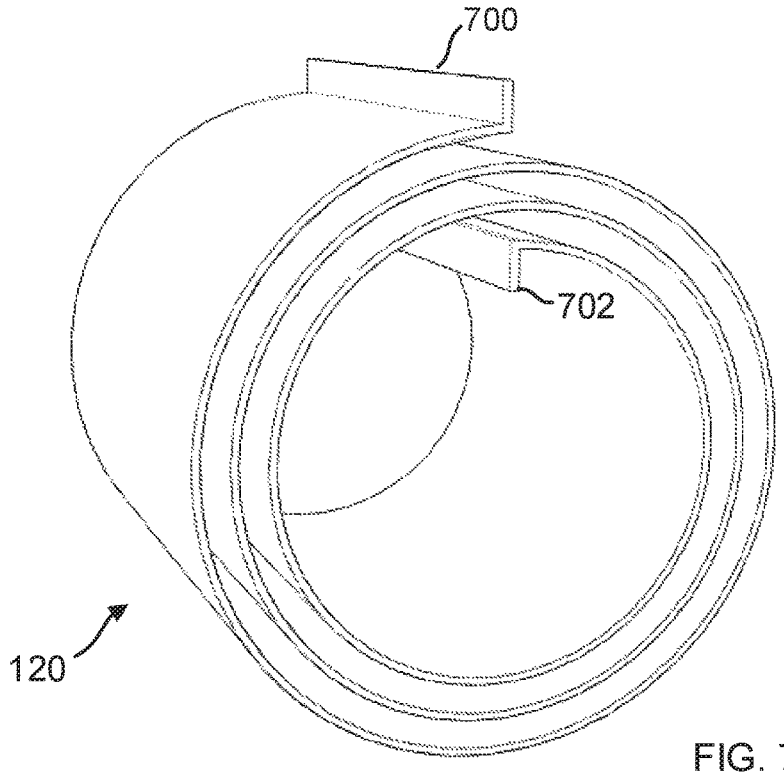
FIG. 7A shows a 3D view of a recoil spring used in the system of FIG. 1A, according to one aspect of the present disclosure.
Figure 7B:
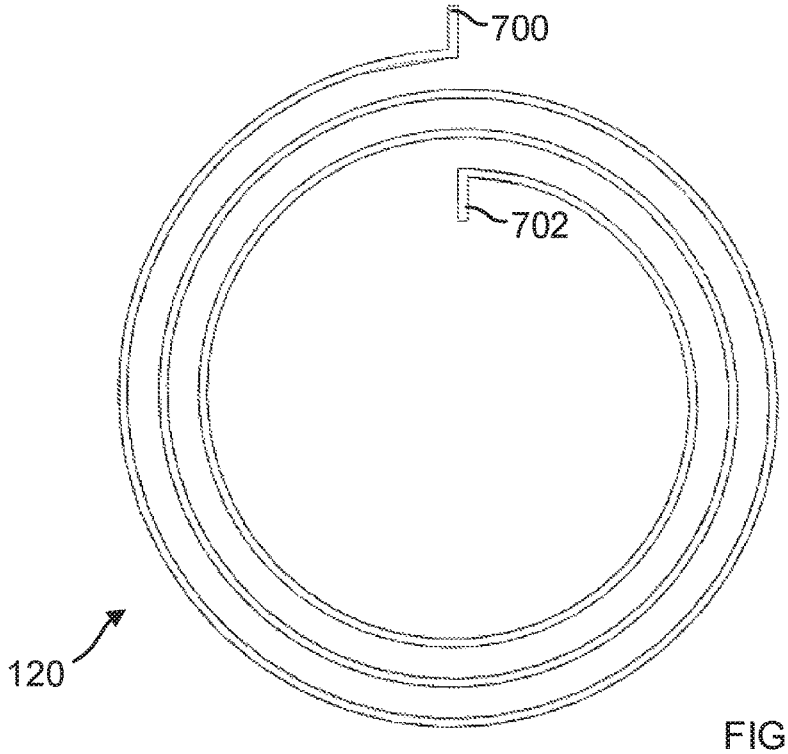
FIG. 7B shows a 2D view of the recoil spring of FIG. 7A, according to one aspect of the present disclosure.

Recoil Spring 120: FIG. 7A shows a 3D view of the recoil spring 120 and FIG. 7B shows a 2D, front view. The recoil spring ends 700 and 702 engage within opening 502 of the center hub 116.

Figure 8A:
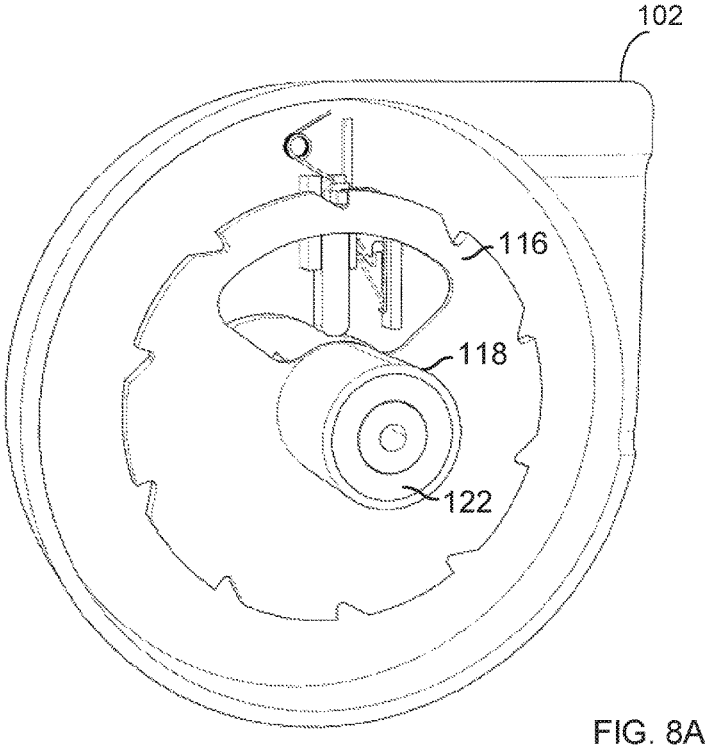
FIG. 8A shows a 3D view of a partial assembly of the system of FIG. 1A, according to one aspect of the present disclosure.

Partial Assembly 100: FIG. 8A shows a 3D view of a partial assembly of system 100 where the center hub 116 is engaged with housing 102. In one aspect, the first cylindrical portion 118 is engaged with the cylindrical protrusion 124 of the housing 102. In one aspect, the cover 122 is secured by a screw (or any other fastener type (not shown)) to cover opening 124A of the cylindrical protrusion 124.

Figure 8B:
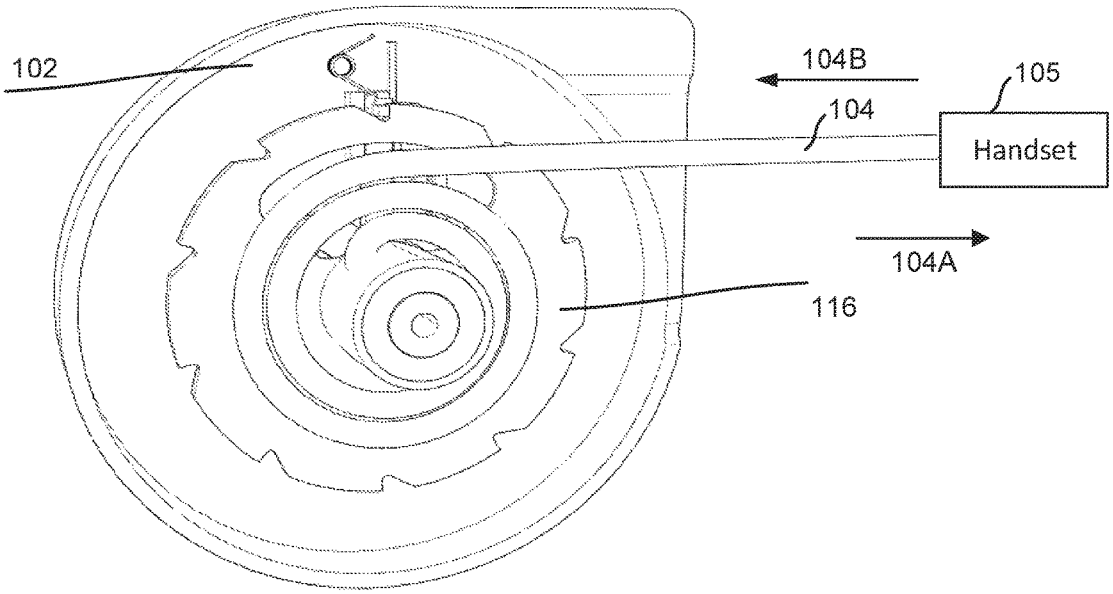
FIG. 8B shows a 3D view of the partial assembly of the system of FIG. 1A with a cable and a handset, according to one aspect of the present disclosure.

FIG. 8B shows the cable 104 coupled to a handset 105. The handset 105 may be similar to one used on transportation vehicles for accessing content and seat functionality. The cable 104 is engaged with the first cylindrical portion 118 of the center hub 116. The cable 104 is pulled in the direction 104A by a user and retracts in direction 104B.

Figure 9A:
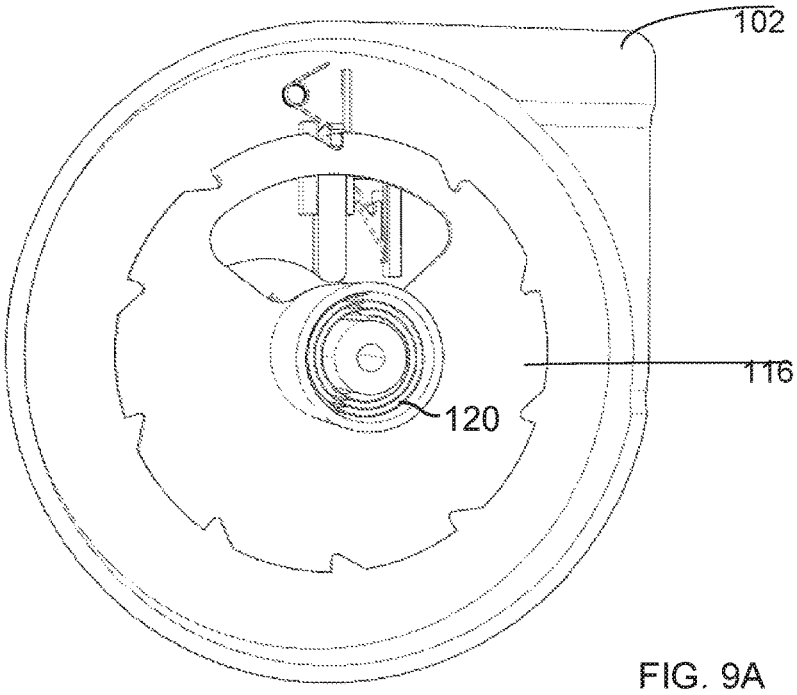
FIG. 9A shows a 3D view of a partial assembly of the system of FIG. 1A with a recoil spring, according to one aspect of the present disclosure.
Figure 9B:
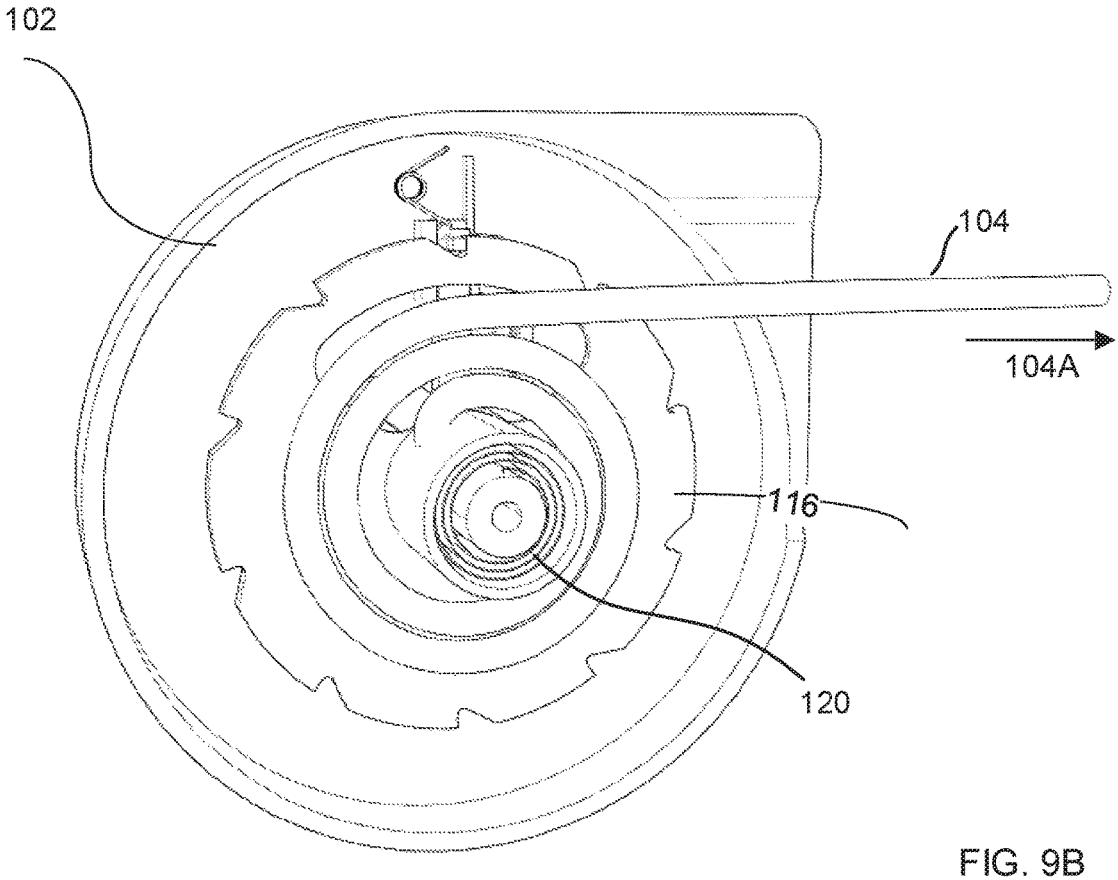
FIG. 9B shows a 3D view of a partial assembly of the system of FIG. 1A with a cable and the recoil spring, according to one aspect of the present disclosure.

FIG. 9A is substantially similar to the FIG. 8A view without the cover 122 and shows the placement of the recoil spring 120 within opening 502 of the center hub 116. FIG. 9B is substantially similar to FIG. 8B without the cover 122.

Figure 10A:
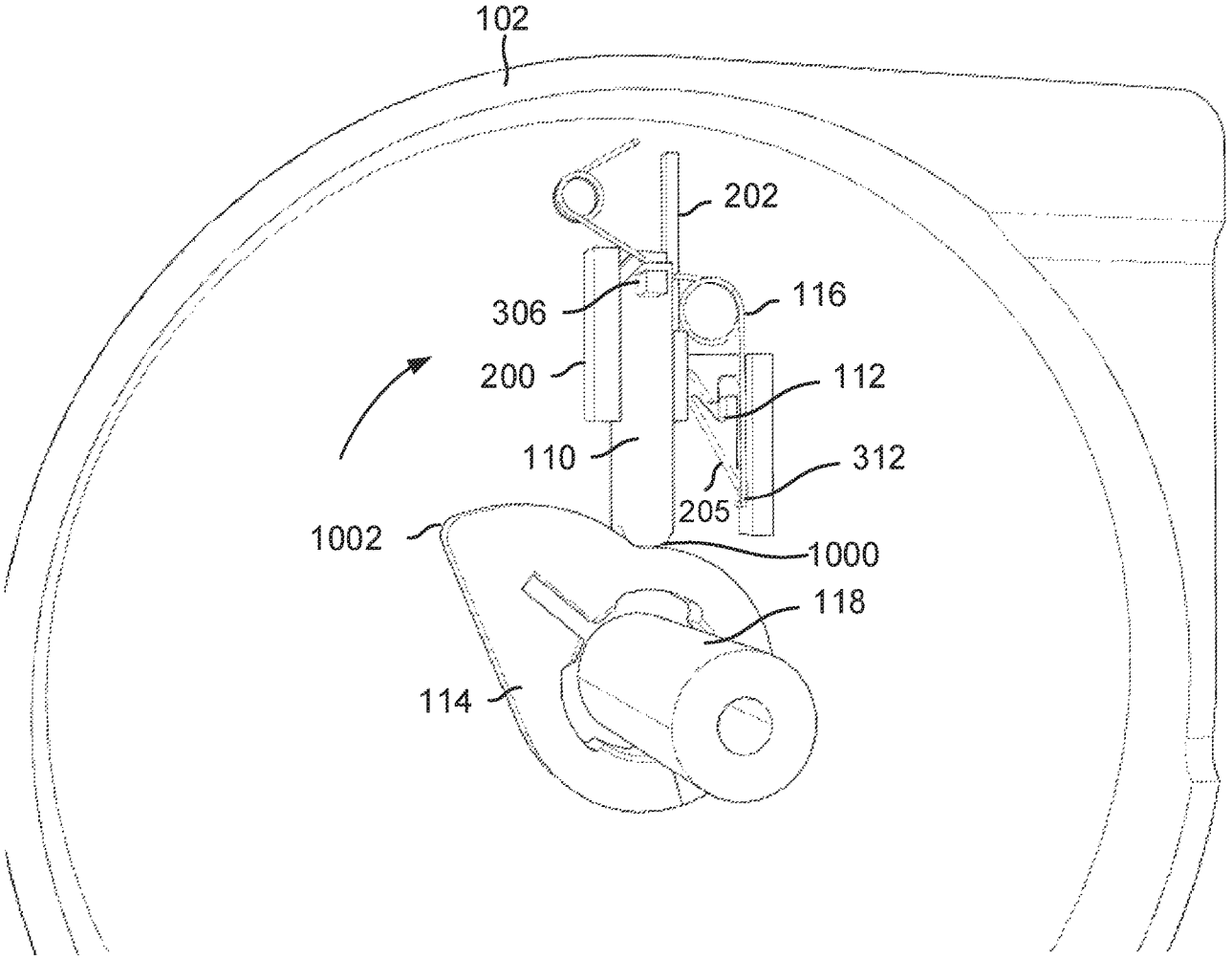
FIG. 10A shows a 3D view of a partial assembly of the system of FIG. 1A in an initial locked position, according to one aspect of the present disclosure.

Operation of System 100: FIGS. 10A-10L and 11A-11C illustrate the operation of system 100 showing various positions of the slider 110, the second torsion spring 112 and cam 114, according to one aspect of the present disclosure. FIG. 10A shows a starting, locked position for system 100, when cable 104 does not retract in direction 104B (FIG. 8B). The cam 114 makes contact with slider 110 at a location 1000. This is the lowest position for the slider 110. The bent tip 312 of the second torsion spring 116 is also at its lowest position below the hypotenuse surface 205. The first torsion spring 108 applies constant pressure on the slider 110 in the downward direction in a vertical plane defined by channel 204. When the slider 110 is in the position shown in FIG. 10A, the recoil spring 120 (not shown in FIG. 10A, see FIGS. 9A/9B) is able to pull the cable 104 such that the cable 104 is retracted. Protrusion 306 is caught at one of the notches 504A-504N (shown in FIG. 5A) of the center hub 116.

Figure 10B:
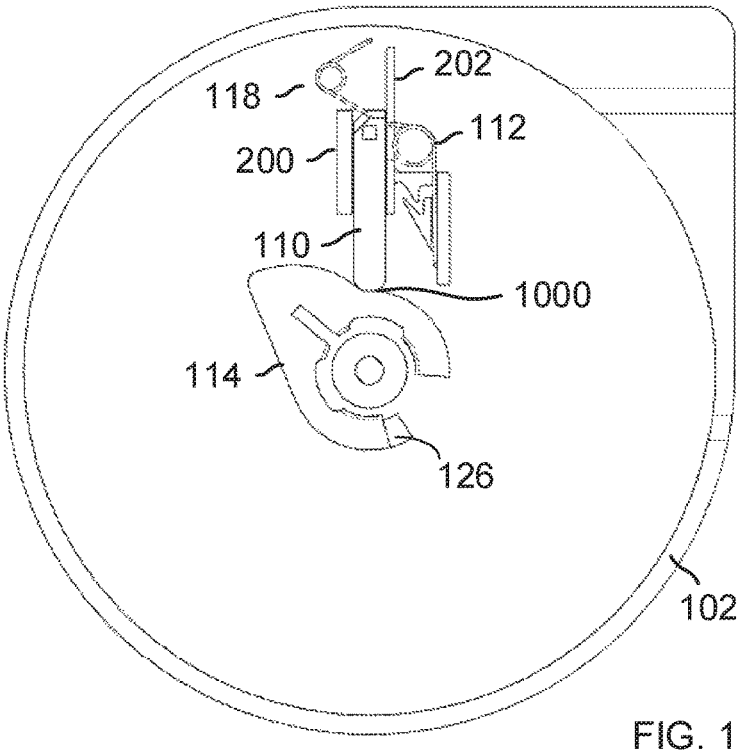
FIG. 10B shows a 2D view of the partial assembly of FIG. 10A, according to one aspect of the present disclosure.

FIG. 10B shows a 2D view similar to FIG. 10A to clearly show the slider 110 location. FIG. 10B also shows the stopper 126 that stops cam 114 to limit cam 114's rotational distance.

Figure 10E:
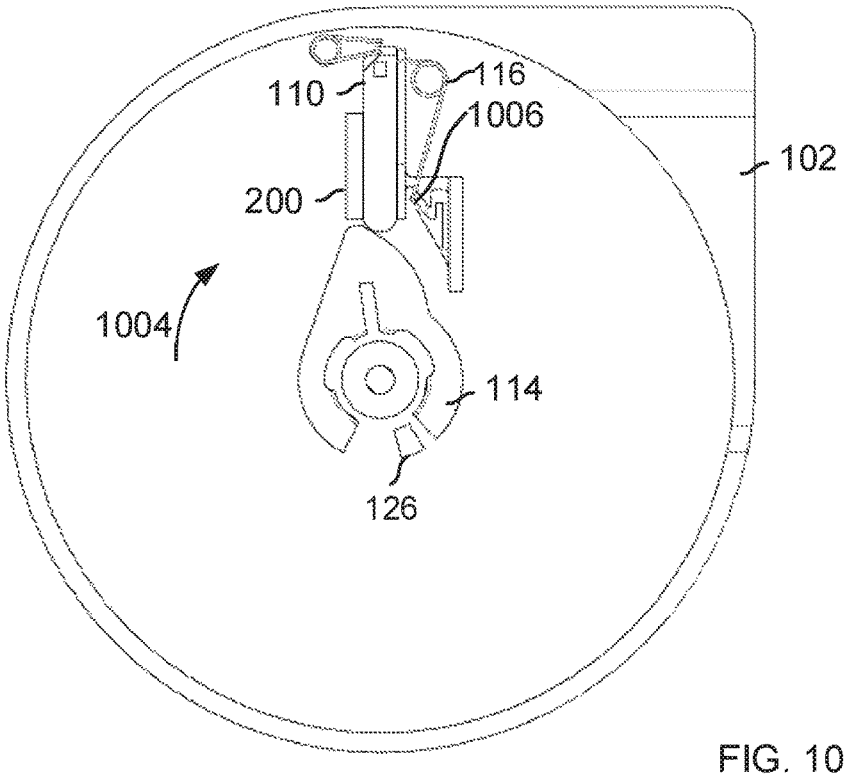
FIG. 10E shows a 2D view of the partial assembly of FIG. 10D, according to one aspect of the present disclosure.
Figure 10C:
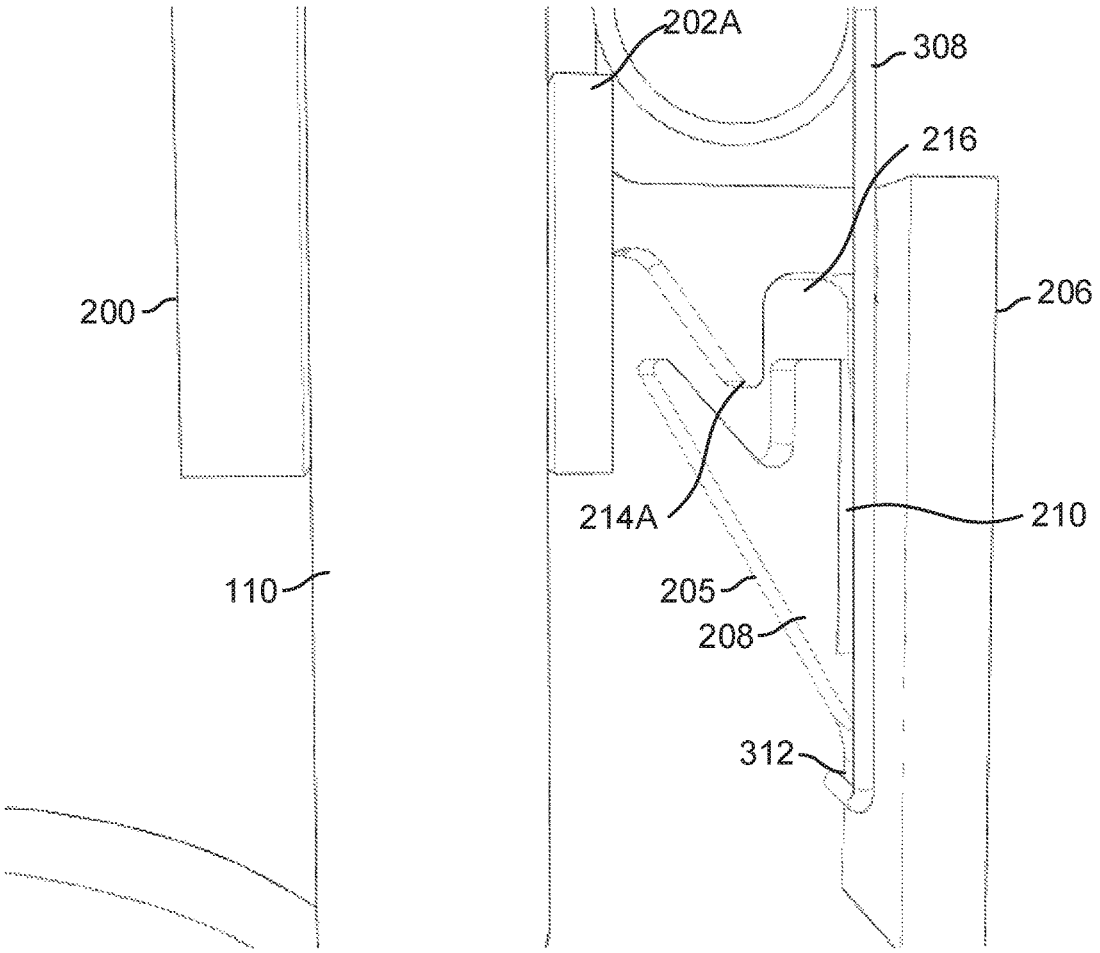
FIG. 10C shows a detailed 3D view with a position of a second torsion spring in the initial position of FIG. 10A, according to one aspect of the present disclosure.

FIG. 10C illustrates the position of the bent tip 312 below the ramp 210 and the hypotenuse surface 205. FIG. 10C also illustrates the various details of the groove and ramp segment that have been described above with respect to FIGS. 2A-2E.

Figure 10D:
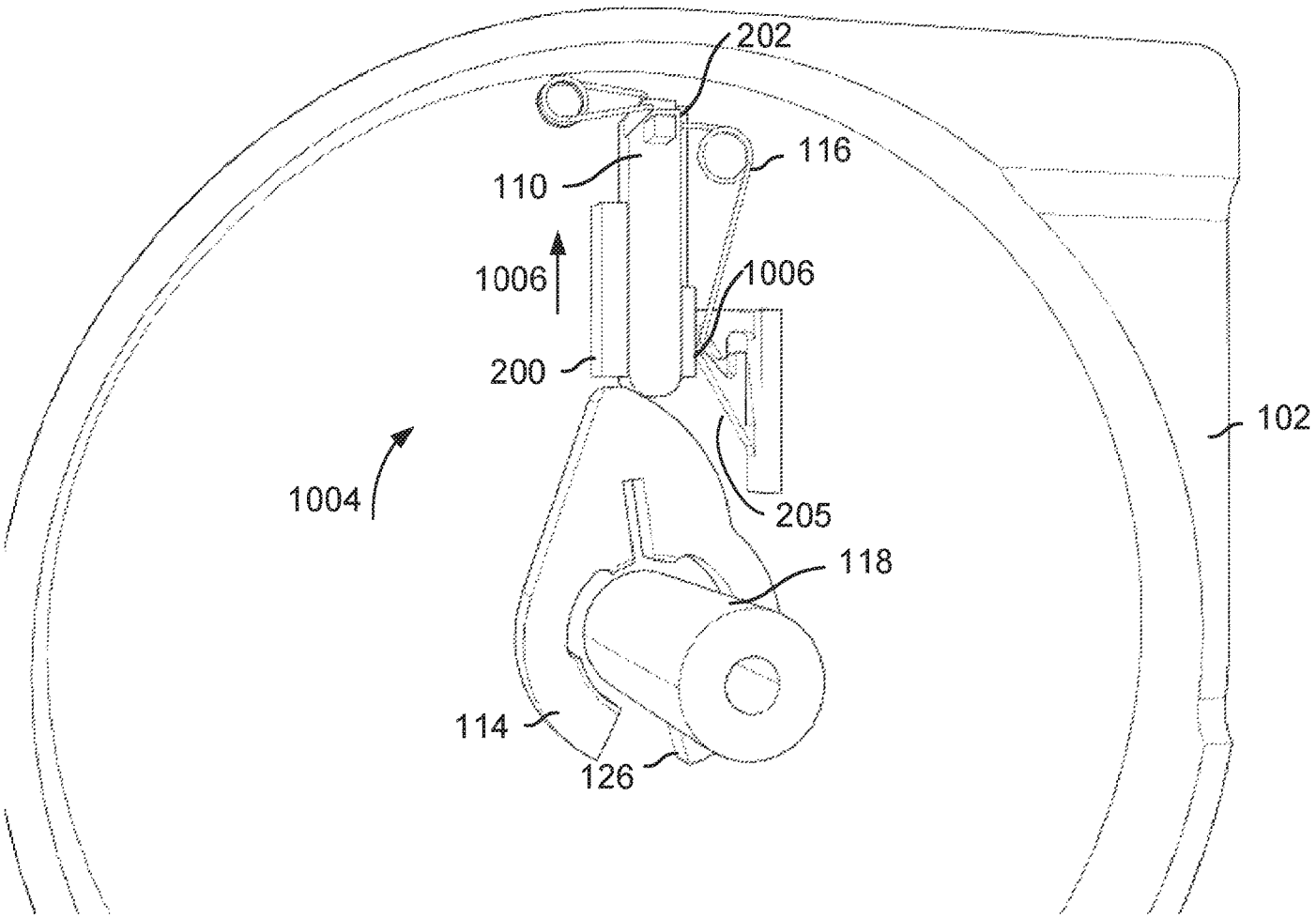
FIG. 10D shows a 3D view of the partial assembly of FIG. 1A, after a cam of the system of FIG. 1A has moved, according to one aspect of the present disclosure.

FIG. 10D shows a position of the cam 114 after a user pulls the cable 104 in the direction 104A [FIG. 8B]. The cam 114 moves in the clockwise direction shown by arrow 1004. Because of the cam movement, the slider 110 slides upwards as shown by the arrow 1006. The second torsion spring 116 slides up the hypotenuse surface 205 and the bent tip 312 rests in position 1006 at the top of the hypotenuse surface 205.

Figure 10F:
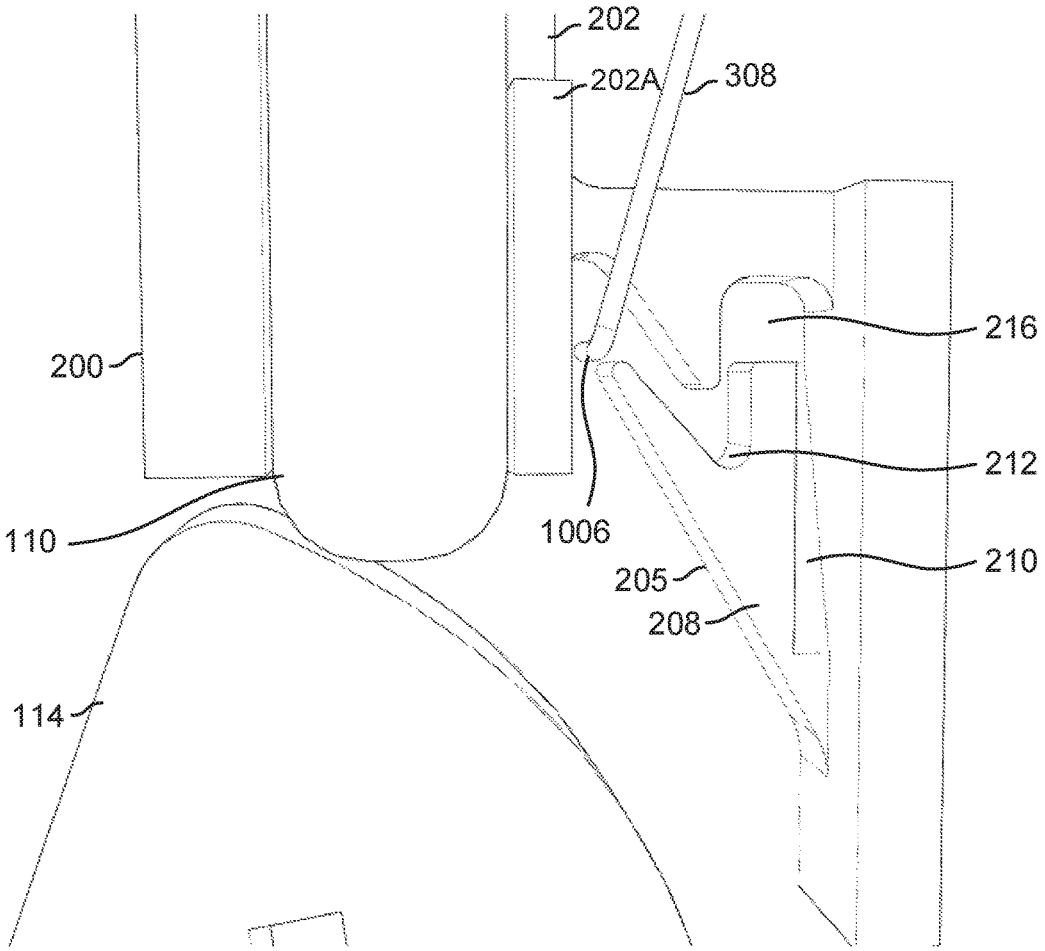
FIG. 10F shows a 3D view of the partial assembly of FIG. 10D with details of a position of a second torsion spring used by the system of FIG. 1A, according to one aspect of the present disclosure.

FIG. 10E shows a front 2D view similar to FIG. 10A. As shown in FIG. 10E, the rotational distance of the cam 114 is limited by the placement of stopper 126 on the inside surface of housing 102. FIG. 10F shows the details of the location of the bent tip 312 of the second torsion spring above the hypotenuse surface 205.

Figure 10G:
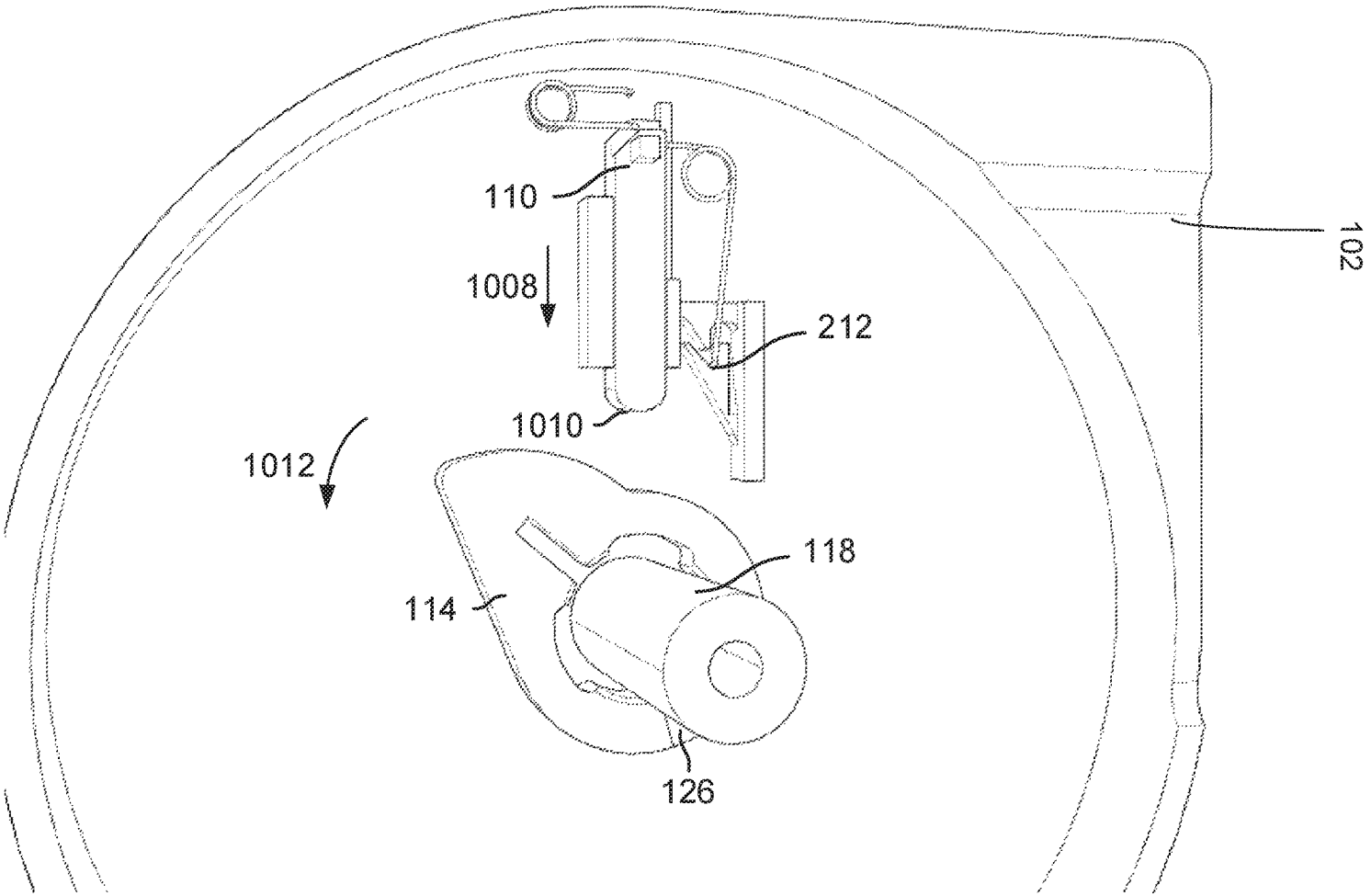
FIG. 10G shows a 3D view of the partial assembly of FIG. 1A, after a user has released a cable, according to one aspect of the present disclosure.
Figure 10H:
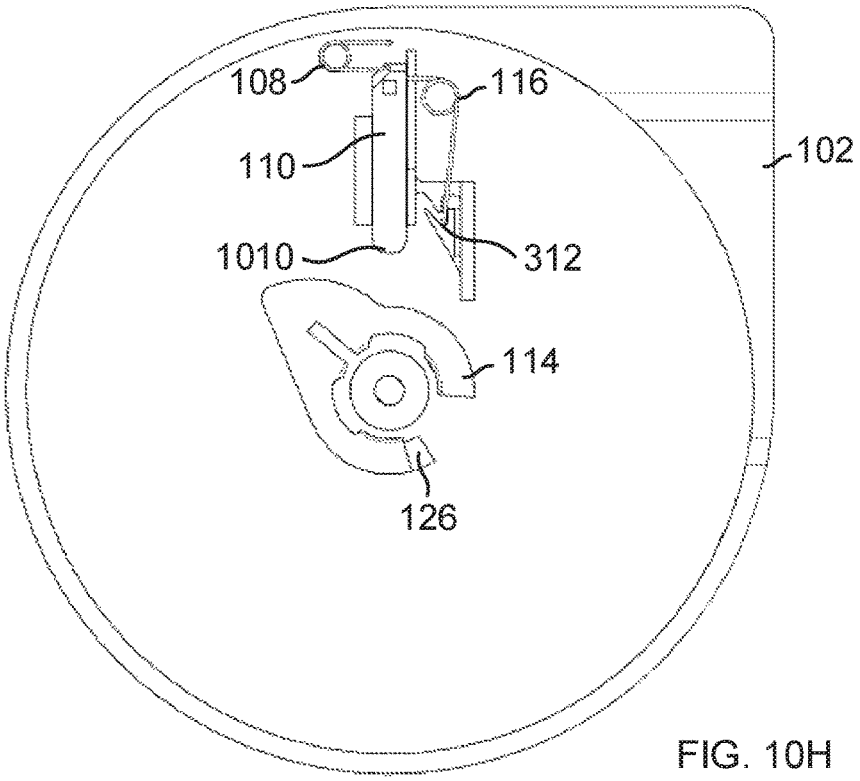
FIG. 10H shows a 2D view of the partial assembly of FIG. 10G, according to one aspect of the present disclosure.

When the user releases the cable 104, the slider 110 slides down (shown by arrow 1008) to a position 1010 as shown in FIG. 10G. The position 1010 of the slider 110 is higher than the position 1000 shown in FIGS. 10A/10B, and therefore it does not get caught by the notches and the cable 104 is free to retract. Thus the cable 104 is now in an "unlocked state". FIG. 10H shows a 2D view of the assembly from FIG. 10G with stopper 126 limiting the rotational movement of cam 114. FIG. 101 shows the position of the bent tip 312 of the second torsion spring within valley 212 of the groove 216.

Figure 10K:
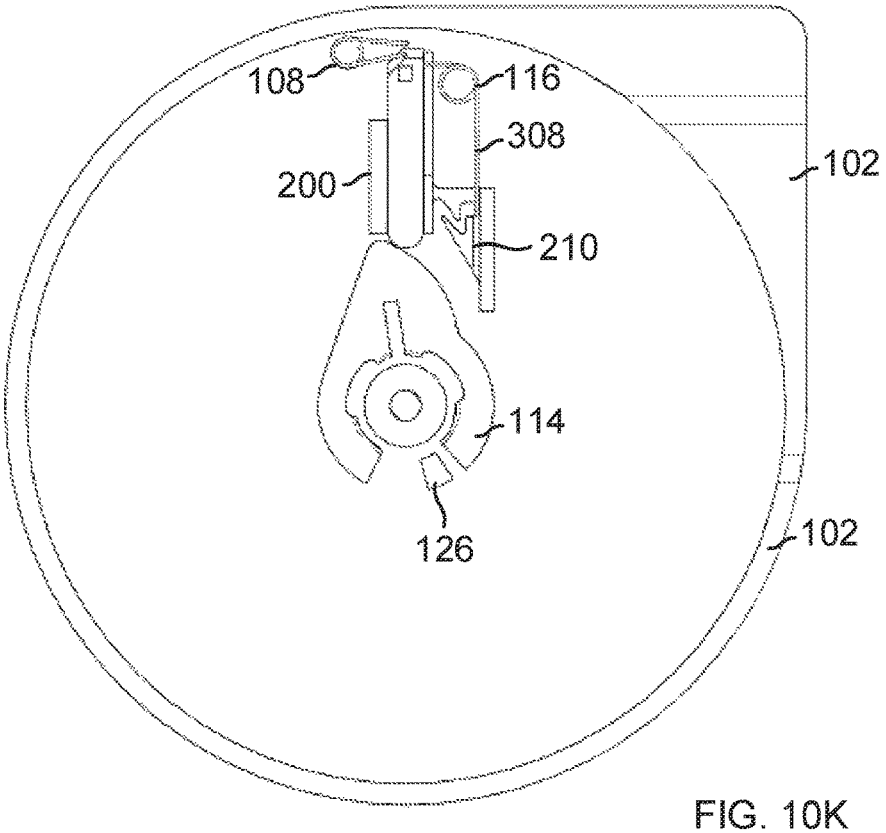
FIG. 10K shows a 2D view of the partial assembly of FIG. 10J, according to one aspect of the present disclosure.
Figure 10I:
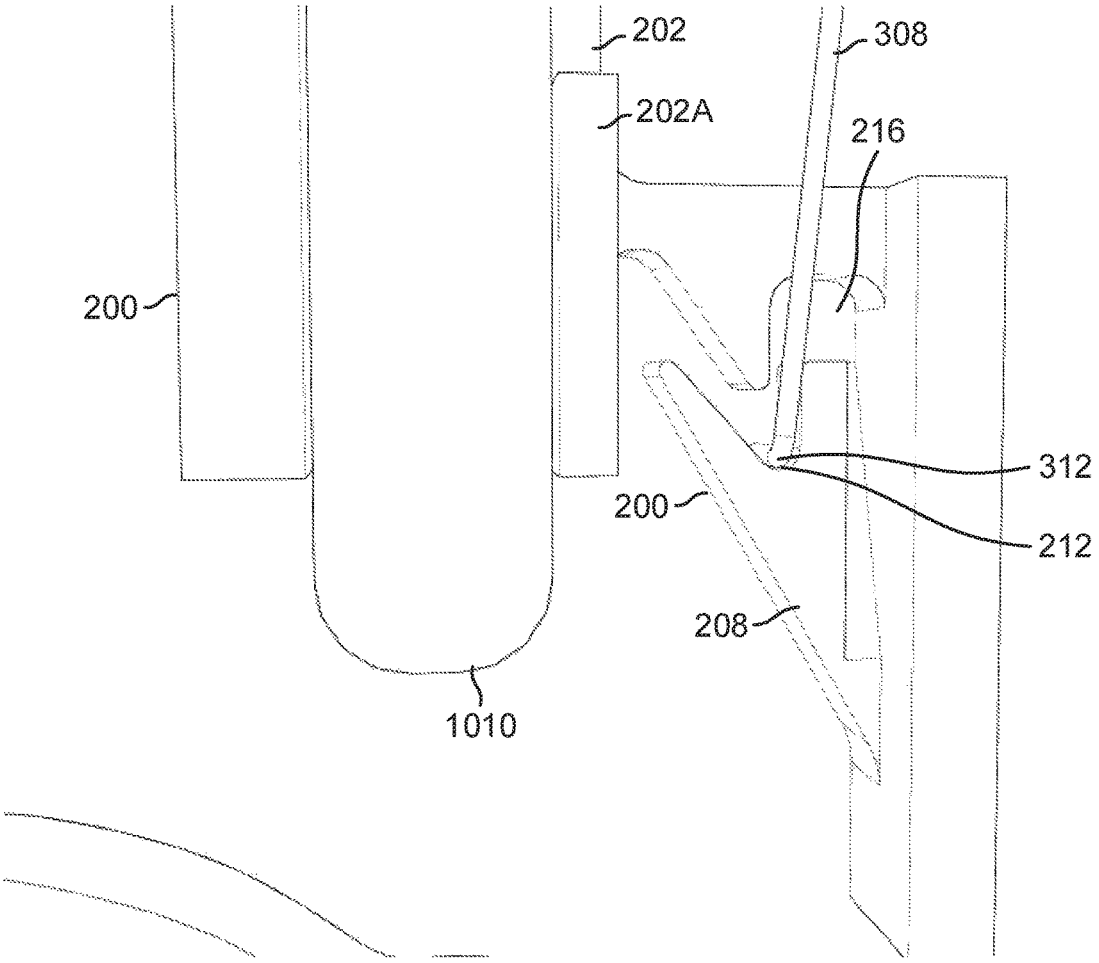
FIG. 10I shows a 3D view of the partial assembly of FIG. 10G with details of a position of a second torsion spring used by the system of FIG. 1A, according to one aspect of the present disclosure.
Figure 10J:
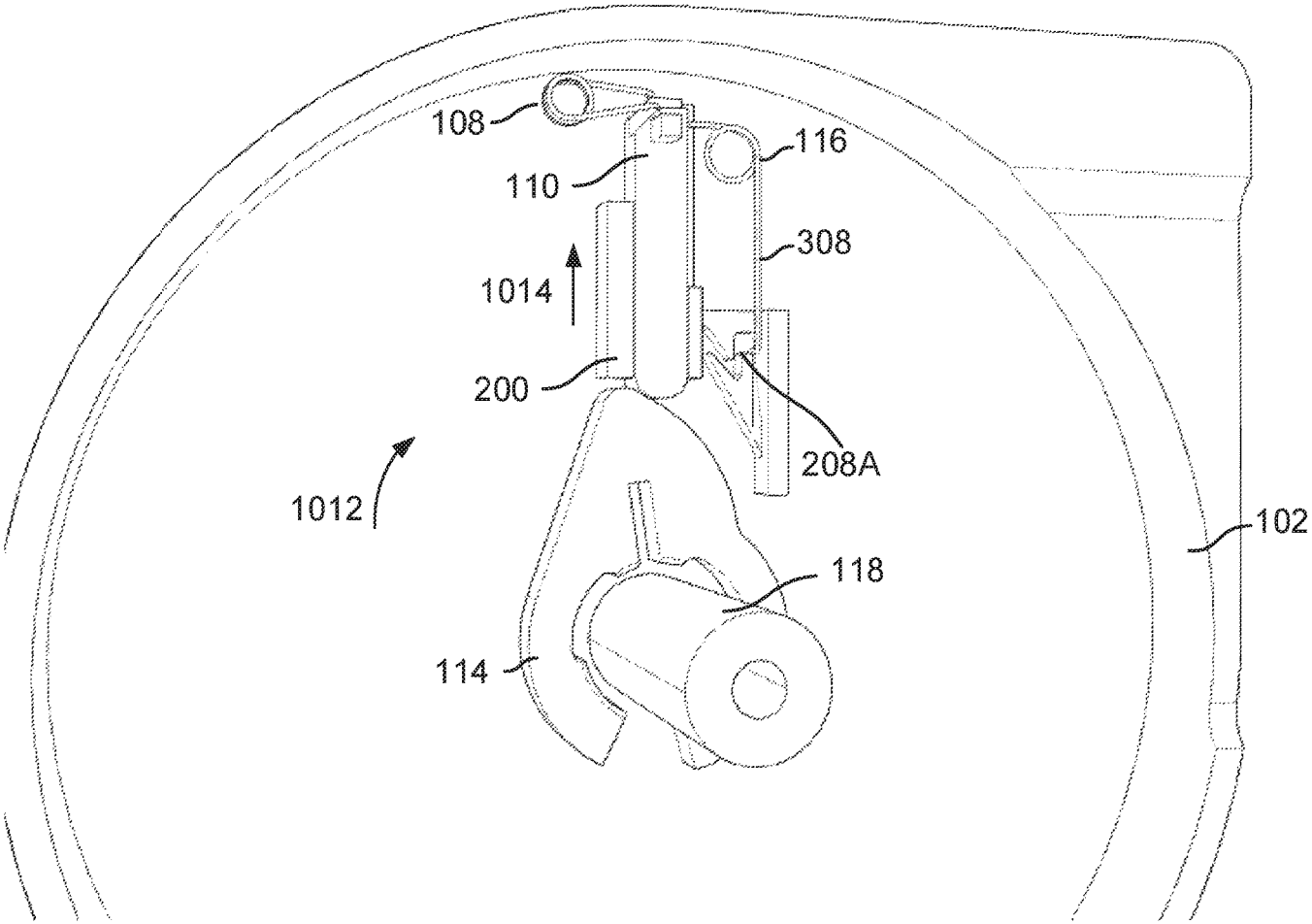
FIG. 10J shows a 3D view of the partial assembly of FIG. 1A, after a user pulls a cable, according to one aspect of the present disclosure.
Figure 10L:
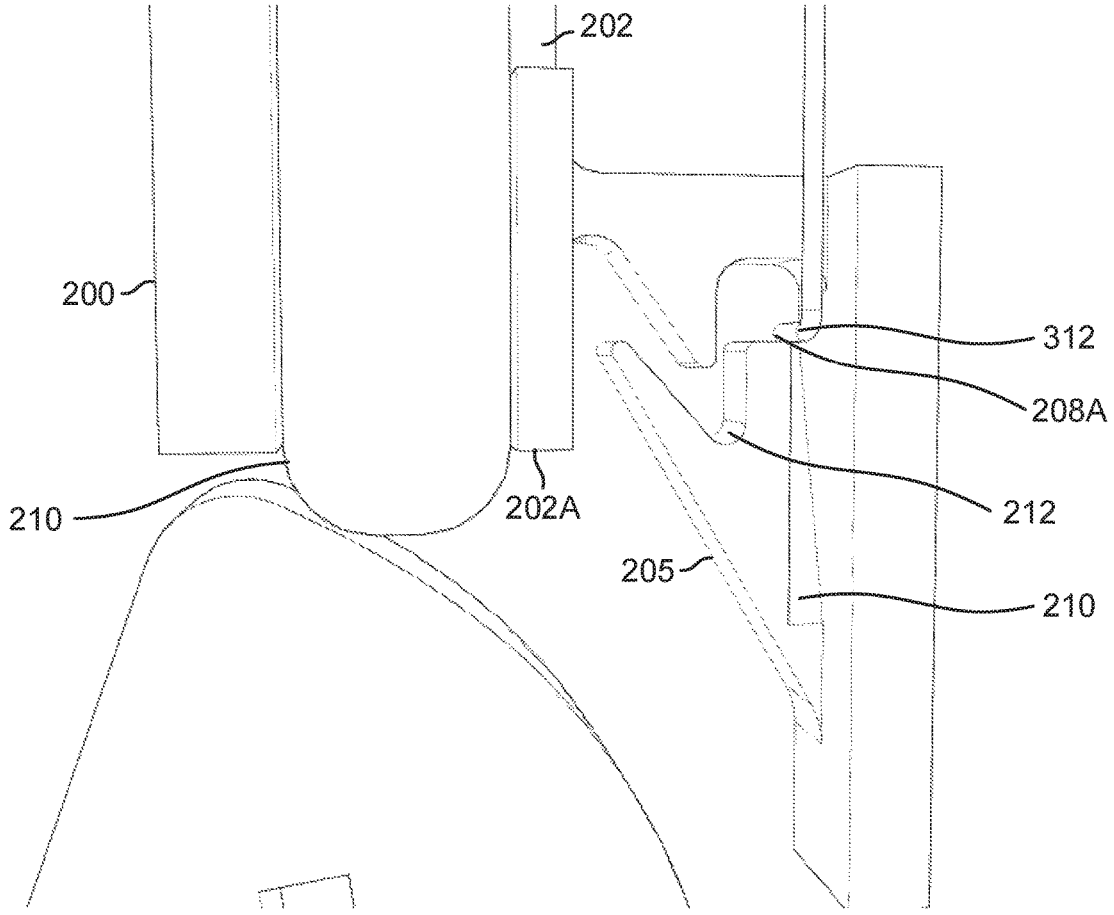
FIG. 10L shows a 3D view of the partial assembly of FIG. 10J with details of a position of a second torsion spring used by the system of FIG. 1A, according to one aspect of the present disclosure.

When the user again pulls the cable 104 in the direction 104A, the cam 114 travels in the clockwise direction 1012, as shown in FIG. 10J. The slider 110 slides upwards (shown by arrow 1014) within channel 204. The bent tip 312 of the second torsion spring 116 moves from the valley 212 to surface 208A of the structure 208. FIG. 10K is a 2D view of the assembly of FIG. 10J. FIG. 10L shows the position of the bent tip 312 on surface 208A in detail.

Figure 11A:
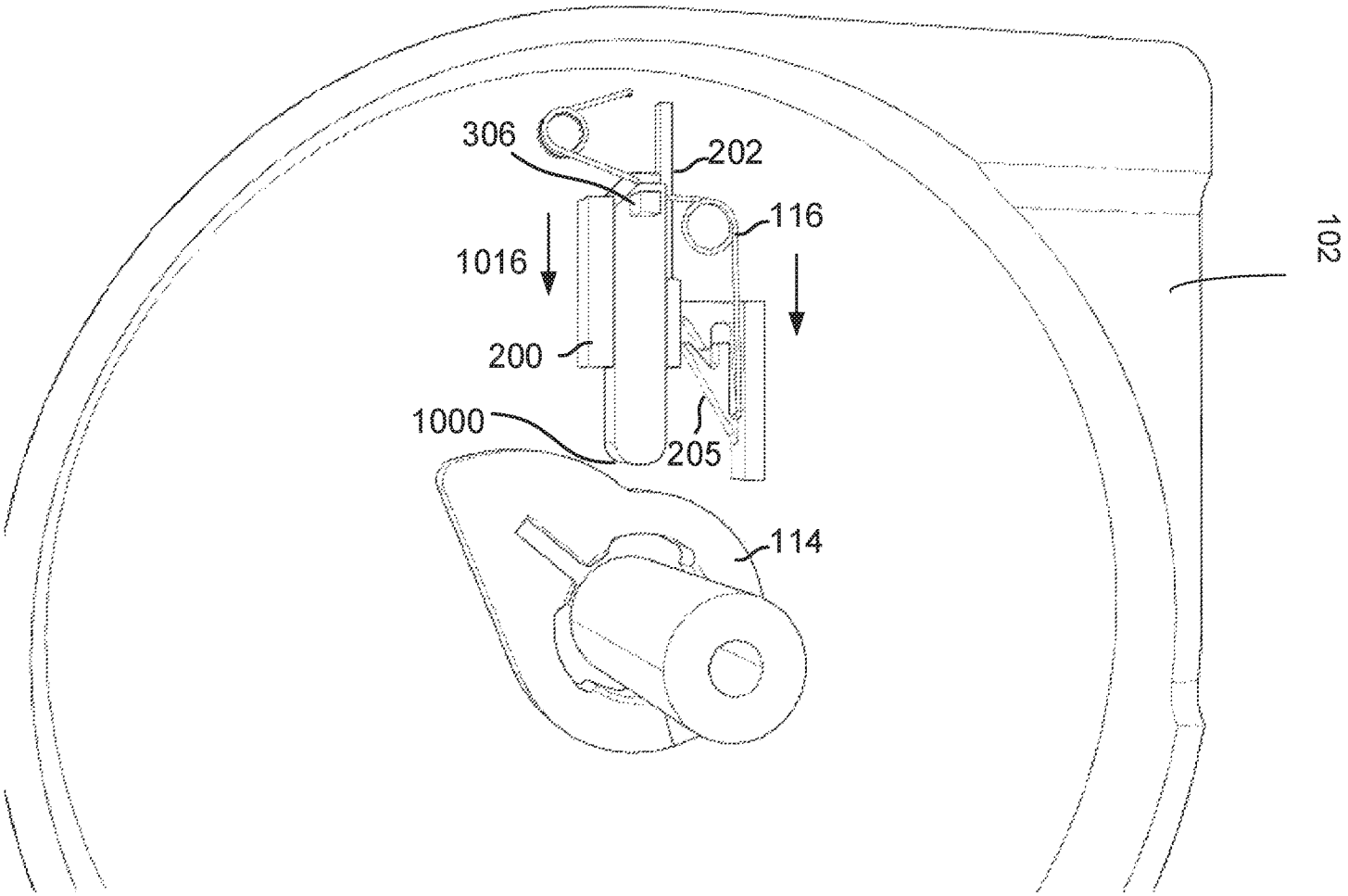
FIG. 11A shows a 3D view of the partial assembly of FIG. 1A, after a user releases a cable, according to one aspect of the present disclosure.
Figure 11B:
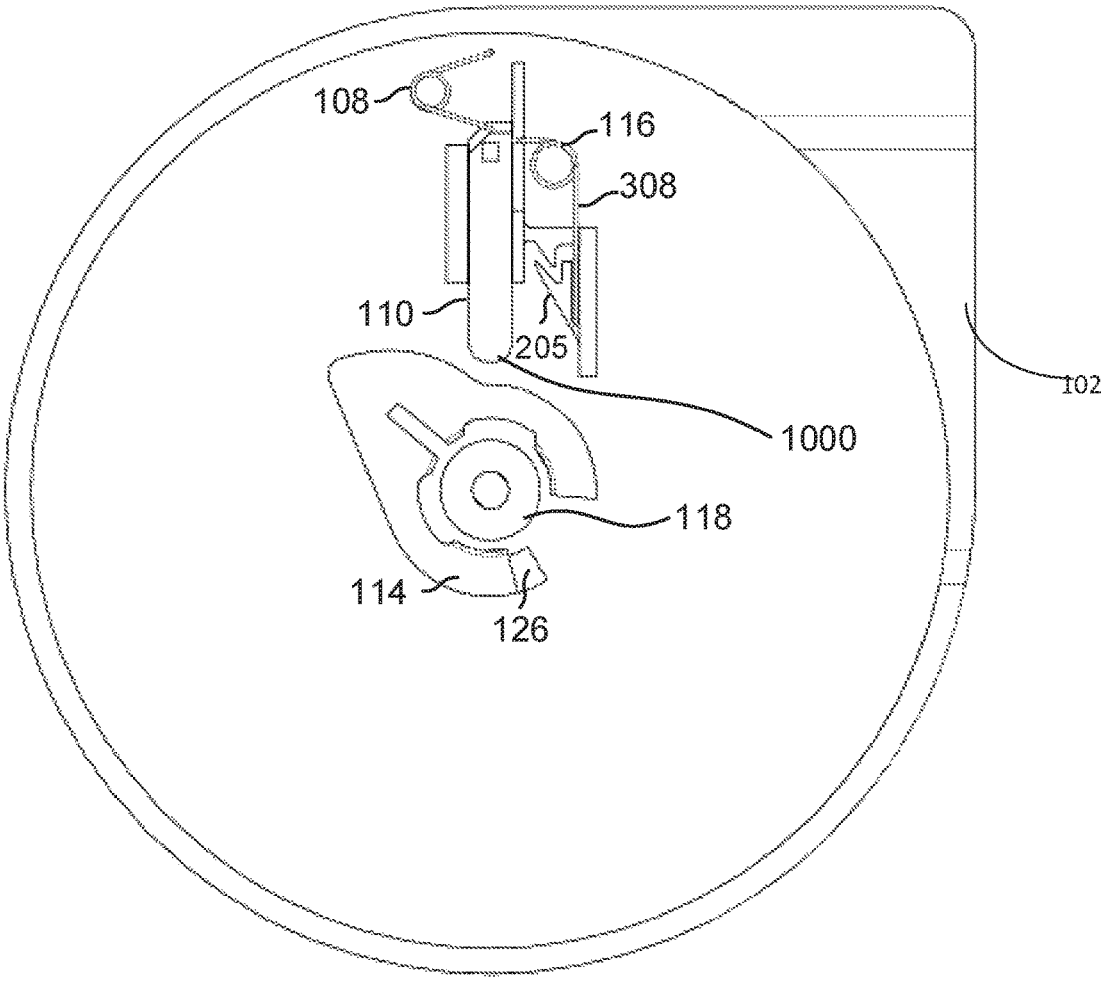
FIG. 11B shows a 2D view of the partial assembly of FIG. 11A, after a user has released a cable, according to one aspect of the present disclosure.

When the user from FIG. 10L releases the cable 104, the slider 110 slides downwards as shown by arrow 1016 in FIG. 11A to the same position 1000 shown in FIG. 10A. The bent tip 312 of the second torsion spring 116 slides down the ramp 210 to the lowest position below the hypotenuse surface 205. The protrusion 306 engages with one of the center hub notches (504A-504N) and the slider 110 is now in a locked state. FIG. 11B shows a 2D view of FIG. 11A, where the stopper 126 limits the cam 114 movement.

Figure 11C:
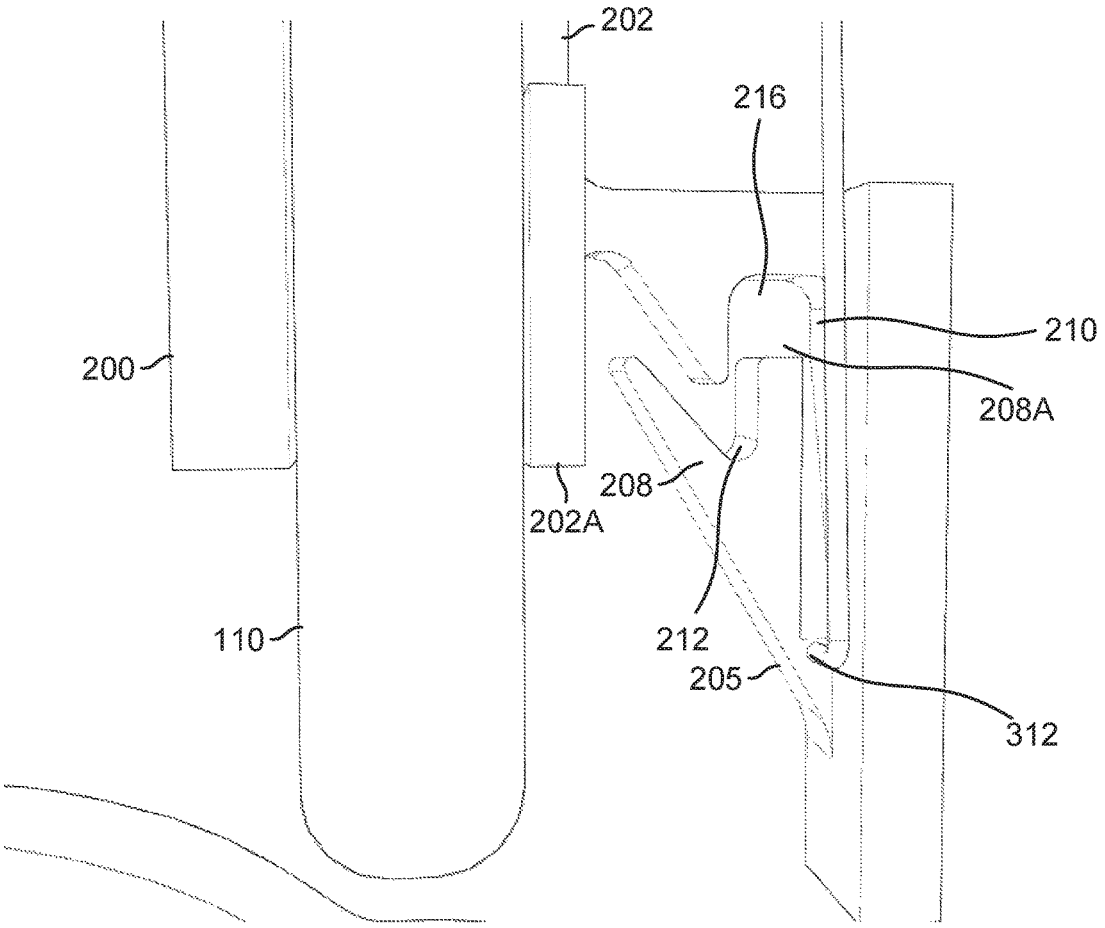
FIG. 11C shows a 3D view of the partial assembly of FIG. 11A with details of a position of a second torsion spring used by the system of FIG. 1A, according to one aspect of the present disclosure.

FIG. 11C shows the details of bent tip 312 at the lowest position below the hypotenuse surface 205 and the ramp 210. When the user starts to pull the cable again, the cycle from FIG. 10A starts over i.e. the bent tip 312 starts to move up the hypotenuse surface 205 via valley 212, to the surface 208A and via ramp 210 to its lowest position.

System 100 components may be metallic or non-metallic. Metallic components may be machined, die-cast or manufactured using any existing or future manufacturing techniques. Non-metallic parts may be injection molded or fabricated using any manufacturing technique. It is noteworthy that the adaptive and innovative technology is not limited to any specific material or manufacturing technique.

System 100 described above has various advantages over conventional ratchet/pinion based mechanisms. For example, because the center hub has numerous notches, the resolution for cable movement is improved. Since system 100 does not use ratchet/pinion mechanisms, it is quieter than conventional systems. Furthermore, the system 100 design is compact and can meet stringent form factor and weight requirements of an aircraft.

Thus, innovative technology for a cable retraction system has been described. Note that references throughout this specification to "one aspect" (or "embodiment") or "an aspect" mean that a particular feature, structure or characteristic described in connection with the aspect is included in at least one aspect of the present disclosure. Therefore, it is emphasized and should be appreciated that two or more references to "an aspect" or "one aspect" or "an alternative aspect" in various portions of this specification are not necessarily all referring to the same aspect. Furthermore, the particular features, structures or characteristics being referred to may be combined as suitable in one or more aspects of the disclosure, as will be recognized by those of ordinary skill in the art.

While the present disclosure is described above with respect to what is currently considered its preferred aspects, it is to be understood that the disclosure is not limited to that described above. To the contrary, the disclosure is intended to cover various modifications and equivalent arrangements within the spirit and scope of the appended claims.

What is claimed is:

1. A cable retraction system for use with a cable, the system comprising:

a housing with a channel and a groove and ramp segment;

a slider with a protrusion extending in a horizontal plane, the slider configured to slide in a vertical plane within the channel;

a first spring for applying pressure on the slider in one direction of the vertical plane;

a center hub having a plurality of notches, a first cylindrical portion and a second cylindrical portion, the center hub operationally coupled to the housing in which the cable wraps around a circumference of the first cylindrical portion of the center hub;

a cam that rotates along a circumference of the second cylindrical portion of the center hub, where a cam rotational distance is controlled by a location of a stopper on a same surface as the channel of the housing; and a second spring having a first segment connected to the slider and a second segment, where the second segment has a bent tip that traverses the groove and ramp segment along with a movement of the slider and the cam;

wherein in an initial state the cable does not retract and the slider is engaged with one of the plurality of notches, and the bent tip is located at a lowest position of the groove and ramp segment in the vertical plane.

2. The system of claim 1, wherein the cam rotates by a pre-determined distance and the slider slides upwards in the channel after the cable is pulled.

3. The system of claim 2, wherein the bent tip of the second spring traverses a hypotenuse surface of the groove and ramp segment, while the first spring applies pressure on the slider in a downward direction of the vertical plane.

4. The system of claim 3, wherein the slider slides downwards after the cable is released such that a lowest surface of the slider is higher than a position of the lowest surface of the slider in the initial state.

5. The system of claim 4, wherein the bent tip of the second spring moves to a lowest point of a valley of the groove and ramp segment.

6. The system of claim 5, wherein the slider slides upwards in the vertical plane after the cable is pulled again and the bent tip of the second spring moves upwards towards a ramp of the groove and ramp segment.

7. The system of claim 6, wherein the bent tip of the second spring and the slider move to the initial state after the cable is released.

8. The system of claim 7, wherein the protrusion of the slider engages with a notch from among the plurality of notches after the cable is released.

9. The system of claim 1, wherein the cable retraction system is used on an aircraft.

10. The system of claim 1, wherein the cable retraction system is used on a transportation vehicle from one or more of a train, a bus, a ship and a recreation vehicle.

11. A cable retraction system for use with a cable, the system comprising:

a slider configured to slide in a vertical plane of a channel;

a first spring for applying pressure on the slider in one direction of the vertical plane; and a second spring having a first segment and a second segment, where first segment is connected to the slider and the second segment has a bent tip that traverses a groove and ramp segment with movement of the slider in the vertical plane;

wherein in an initial state, a cable does not retract and the bent tip is located at a lowest position of the groove and ramp segment in the vertical plane;

wherein after the cable is pulled, the slider slides upwards in the channel and the bent tip of the second spring traverses a hypotenuse surface of the groove and ramp segment; and wherein after the cable is released, the slider slides downwards in the vertical plane such that a lowest surface of the slider is higher than a position of the lowest surface of the slider in the initial state and the bent tip of the second spring moves to a lowest point of a valley of the groove and ramp segment.

12. The system of claim 11, wherein after the cable is pulled again, the slider slides upwards in the vertical plane and the bent tip of the second spring moves upwards towards a ramp of the groove and ramp segment and wherein the bent tip of the second spring and the slider move to the initial state after the cable is released again.

13. The system of claim 11, further comprising:

a housing with the channel and the groove and ramp segment and the slider includes a protrusion extending in a horizontal plane.

14. The system of claim 13, further comprising, a center hub having a plurality of notches, a first cylindrical portion and a second cylindrical portion, the center hub operationally coupled to the housing; wherein in the initial state the slider protrusion is engaged with one of the plurality of notches.

15. The system of claim 14, further comprising:

a cam that rotates along a circumference of the second cylindrical portion of the center hub, where a cam rotational distance is controlled by a location of a stopper at an inner surface of the housing.

16. The system of claim 14, wherein the cable is wrapped along a circumference of the first cylindrical portion of the center hub.

17. A cable retraction system for use with a cable, the system comprising:

a slider configured to move in a vertical plane within a channel; and a spring having a first segment connected to the slider and a second segment with a bent tip that traverses a groove and ramp segment with a movement of the slider;

wherein in an initial state, the cable does not retract and the bent tip is located at a lowest position of the groove and ramp segment in the vertical plane; and after the cable is pulled, the slider slides upwards in the channel and the bent tip of the spring traverses a ramp of the groove and ramp segment.

18. The system of claim 17, wherein after the cable is released, the slider slides downwards in the vertical plane such that a lowest surface of the slider is higher than a position of the lowest surface of the slider in the initial state and the bent tip of the spring moves to a lowest point of a valley of the groove and ramp segment.

19. The system of claim 18, wherein after the cable is pulled again, the slider slides upwards in the vertical plane and the bent tip of the spring moves upwards towards a ramp of the groove and ramp segment.

20. The system of claim 19, wherein the bent tip of the spring and the slider move to the initial state after the cable is released again.

* * * * *